US010045114B2

(12) United States Patent
Willis et al.

(10) Patent No.: US 10,045,114 B2
(45) **Date of Patent: *Aug. 7, 2018**

(54) EAR ATTACHMENT APPARATUS

(71) Applicant: Human, Incorporated, Seattle, WA (US)

(72) Inventors: Benjamin S. Willis, Bellevue, WA (US); Dae Il Kwon, Edmonds, WA (US)

(73) Assignee: Human, Incorporated, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/365,784

(22) Filed: Nov. 30, 2016

(65) Prior Publication Data

US 2017/0245037 A1 Aug. 24, 2017

Related U.S. Application Data

(63) Continuation of application No. 15/174,873, filed on Jun. 6, 2016, now Pat. No. 9,538,280.
(Continued)

(51) Int. Cl.
*H04R 1/10* (2006.01)

(52) U.S. Cl.
CPC ..... *H04R 1/105* (2013.01); *H04R 1/1008* (2013.01)

(58) Field of Classification Search
CPC ..... H04R 1/105; H04R 1/10; H04R 1/1008
(Continued)

(56) References Cited

U.S. PATENT DOCUMENTS 2,778,889 A 1/1957 Hausdorf
2,802,214 A 8/1957 Hanks
(Continued)

FOREIGN PATENT DOCUMENTS

CN 2430819 Y 5/2001
CN 1964577 A 5/2007
(Continued)

OTHER PUBLICATIONS

European Patent Office; Invitation to Pay Additional Fees and, Where Applicable, Protest Fee; dated Aug. 10, 2016 in International Application No. PCT/US2016/036092; 7 pages.
(Continued)

*Primary Examiner* — Matthew Eason
*Assistant Examiner* — Sabrina Diaz
(74) *Attorney, Agent, or Firm* — Seed IP Law Group LLP

(57) ABSTRACT

Various embodiments provide for an improved attachment apparatus for attaching the attachment apparatus to an ear of a user. In some embodiments, the attachment apparatus may include an attachment body that defines an opening configured to enable at least a portion of a user's ear to pass through the opening when the attachment apparatus is coupled to the user. In such embodiments, the attachment body may prevent an anterior portion of the ear from passing through the opening and may receive, from an interaction with the anterior portion of the ear, a force that biases the first attachment portion in a direction away from a median plane of the user. In some embodiments, the attachment body may secure the attachment apparatus to the ear of the user while the first attachment portion is biased away from the median plane of the user.

17 Claims, 21 Drawing Sheets

Related U.S. Application Data

(60) Provisional application No. 62/172,537, filed on Jun. 8, 2015, provisional application No. 62/325,904, filed on Apr. 21, 2016.

(58) Field of Classification Search
USPC ..... 381/72, 330, 371, 374, 381
See application file for complete search history.

(56) References Cited

U.S. PATENT DOCUMENTS

| | | | |
|---|---|---|---|
| 3,869,584 | A | 3/1975 | Wilde |
| 3,915,166 | A | 10/1975 | McCrink |
| 4,713,843 | A | 12/1987 | Duncan |
| 5,790,683 | A | 8/1998 | Salzani |
| 5,898,945 | A | 5/1999 | Weiser |
| D420,010 | S | 2/2000 | Pitel |
| 6,035,961 | A | 3/2000 | Sun |
| 6,055,672 | A | 5/2000 | Natvig |
| D462,944 | S | 9/2002 | Yuen |
| 6,580,800 | B1 | 6/2003 | Yamasaki et al. |
| 7,006,649 | B2 | 2/2006 | Natvig |
| 7,013,018 | B2 | 3/2006 | Bøgeskov-Jensen |
| D588,112 | S | 3/2009 | Komiyama |
| 7,646,879 | B2 | 1/2010 | Huang |
| 7,869,615 | B2 | 1/2011 | Chang |
| 7,949,127 | B2 | 5/2011 | Pedersen et al. |
| 8,688,036 | B2 | 4/2014 | Parkins et al. |
| 8,818,012 | B2 | 8/2014 | Pelland et al. |
| 2004/0184635 | A1* | 9/2004 | Natvig ..... H04R 1/1058 381/371 |
| 2004/0197001 | A1 | 10/2004 | Terrell |
| 2006/0239446 | A1 | 10/2006 | Gunter et al. |
| 2007/0263896 | A1 | 11/2007 | Chen |
| 2008/0143954 | A1 | 6/2008 | Abreu |
| 2008/0192951 | A1 | 8/2008 | Moura |
| 2008/0263749 | A1* | 10/2008 | Leong ..... A61F 11/14 2/209 |
| 2010/0061581 | A1 | 3/2010 | Soetejo et al. |
| 2012/0124719 | A1* | 5/2012 | Michlitsch ..... A41D 13/05 2/423 |
| 2013/0010997 | A1 | 1/2013 | Tanaka et al. |

FOREIGN PATENT DOCUMENTS

| | | | |
|---|---|---|---|
| EP | 1 874 078 | A1 | 6/2006 |
| EP | 2 028 874 | A1 | 2/2009 |
| JP | 10-257145 | A | 9/1998 |
| JP | 2000-244621 | A | 9/2000 |
| JP | 2002-112377 | A | 4/2002 |
| JP | 2010-206765 | A | 9/2010 |

OTHER PUBLICATIONS

European Patent Office; International Search Report and Written Opinion in international application No. PCT/US2016/036092, dated Oct. 4, 2016; 23 pages.

* cited by examiner

EAR ATTACHMENT APPARATUS

RELATED APPLICATIONS

This application is a continuation of U.S. patent application Ser. No. 15/174,873 entitled "ATTACHMENT APPARATUS," filed on Jun. 6, 2016, which claims the benefit of priority both to U.S. Provisional Application No. 62/172,537 entitled "METHODS FOR ATTACHING AN ELECTRONIC DEVICE TO A HUMAN EAR," filed on Jun. 8, 2015, and to U.S. Provisional Application No. 62/325,904 entitled "HEAD-WORN AUDIO SYSTEM," filed on Apr. 21, 2016. The entire contents of all of the foregoing are hereby incorporated by reference.

BACKGROUND

Users of wearable audio systems—such as headphones and earphones—can choose between several different styles. However, current wearable audio systems typically utilize one of only a few common attachment mechanisms to secure these systems to the user. For example, one type of wearable audio system can be attached to a user's head via a headband that maintains the position of ear cups on either side of the user's head. Another type of wearable audio system can be attached to a user's head by clipping the system to the back of the user's ear. Yet another type of wearable audio system can be attached to the user by inserting the system into the user's ear canal. Current attachment mechanisms, including those described above, are often uncomfortable to wear, especially over time. As such, developing an attachment mechanism that achieves a strong attachment to a user and that improves the user's comfort and overall experience continues to be a design challenge.

SUMMARY

Various embodiments provide for an attachment apparatus configured to couple to an ear of a user. In such embodiments, the attachment apparatus may include an attachment body that includes a first attachment portion. The attachment body may define an opening that enables at least a portion of the ear of the user to pass through the opening when coupling the attachment apparatus to the ear. In some embodiments, the first attachment portion may prevent an anterior portion of the ear from passing through the opening and may receive, from an interaction with the anterior portion of the ear, a force that biases the first attachment portion in a direction away from a median plane of the user. The attachment body may secure the attachment apparatus to the ear of the user while the first attachment portion is biased away from the median plane of the user.

In some embodiments, the attachment body may also include a second attachment portion. The force received on the first attachment portion may cause the second attachment portion to bias in a direction towards the median plane of the user. In such embodiments, the second attachment portion may form at least a partial acoustic seal against the user while biased towards the median plane of the user.

In some embodiments, the first attachment portion may protrude at least partially into the opening such that the first attachment portion limits rotation of the attachment apparatus while the attachment apparatus is secured to the ear. In some embodiments, the first attachment portion may be defined at least partially in reference to a line passing between a point on a first recess of the attachment body and a point on a second recess of the attachment body. The attachment body may also, or alternatively, define, at least partially, a cavity that accommodates the first attachment portion while the first attachment portion is biased away from the median plane of the user.

Various embodiments also provide for an attachment apparatus that includes an attachment body that defines an opening that enables a portion of the ear of the user to pass through the opening when coupling the attachment apparatus to the ear and that includes a frame coupled to the attachment body. In some embodiments, the attachment body may transition from a resting configuration to a deformed configuration in response to a tensile force applied to the attachment body. The frame may bias the attachment body toward the resting configuration when the attachment body is in the deformed configuration. In some embodiments, the frame may be coupled to the attachment body to extend along at least a portion of a perimeter portion of the attachment body surrounding the opening.

In some embodiments, the attachment body may include a first attachment portion and a second attachment portion. In such embodiments, the frame may secure the attachment apparatus to the ear such that the first attachment portion receives, from an interaction with an anterior portion of the ear, a force that biases the first attachment portion in a direction away from a median plane of the user. The force received on the first attachment portion may cause the second attachment portion to press against the user.

In some embodiments, the frame may secure the attachment apparatus to the ear such that a portion of the frame receives, from an interaction with an anterior portion of the ear, a force that biases the portion of the frame in a direction away from a median plane of the user. The force received on the portion of the frame may cause a portion of the attachment body to press against the user.

In some embodiments, the frame may include a first frame portion and a second frame portion. In such embodiments, the first frame portion may secure the attachment apparatus to an upper root portion of the ear. The second frame portion may secure the attachment apparatus to a lower root portion of the ear. In some embodiments, the frame may apply a compressive force to the ear between a point on the first frame portion and a point on the second frame portion while the attachment body is in the resting configuration.

Various embodiments may further provide for an attachment apparatus that includes an attachment body and a frame coupled to the attachment body. In some embodiments, the attachment body may define an opening that is configured to enable at least a portion of the ear of the user to pass through the opening when coupling the attachment apparatus to the ear. In such embodiments, a first frame portion of the frame is configured to displace a posterior portion of the ear in a direction away from a median plane of the user while the attachment apparatus is secured to the ear, and displacement of the posterior portion of the ear by the first frame portion may bias an anterior portion of the attachment body into engagement with the user.

In some embodiments, the first portion of the frame may have a thickness greater than a space between a back surface of the posterior portion of the ear and the head of the user behind the ear with the ear in a non-displaced condition. In some embodiments, the frame may be coupled to the attachment body to extend along at least a portion of a perimeter of the opening.

In some embodiments, the frame body also includes a second frame portion. In such embodiments, the frame may secure the attachment apparatus to the ear such that the second frame portion of the attachment body receives a force from an interaction with the ear that urges the second frame portion away from a median plane of the user. The force received on the second frame portion may bias a portion of the attachment body into engagement with the user. In some embodiments, the anterior portion of the attachment body may engage with the user while the attachment body is secured to an upper portion of the ear and to a lower portion of the ear.

In some embodiments, the first frame portion of the frame may include a midsection that physically contacts a back surface of the posterior portion of the ear. In such embodiments, the midsection may curve away from the head of the user behind the ear and towards the back surface of the ear such that the midsection displaces the posterior portion of the ear in the direction away from the median plane of the user.

In some embodiments, at least a portion of the attachment body may transition from a resting configuration to a deformed configuration in response to receiving a tensile force on the attachment body. In such embodiments, the frame may bias the attachment body toward the resting configuration while the attachment body is in the deformed configuration.

BRIEF DESCRIPTION OF THE DRAWINGS

The foregoing embodiments and many of the attendant advantages will become more readily appreciated as the same become better understood by reference to the following detailed description, when taken in conjunction with the accompanying drawings, wherein.

DETAILED DESCRIPTION

Figure 1A:
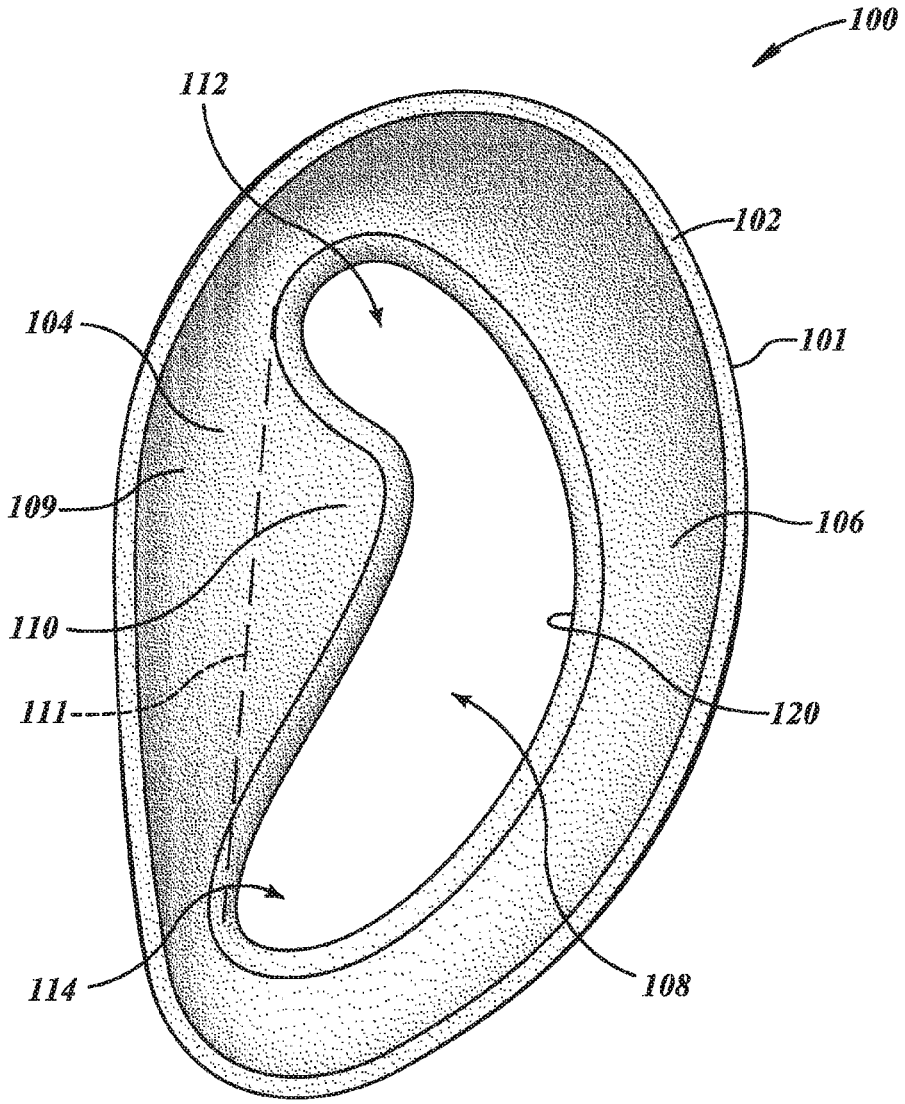
FIG. 1A is an exterior view of a front side of an attachment apparatus, according to some embodiments.

Various embodiments of the attachment apparatus may be described with reference to certain anatomical features of a human ear. For ease of reference, the anatomical features of a user's ear may be referred to in this disclosure using the following terms. The term "root of an ear" refers to a portion of the ear that is proximal to the user's head. Specifically, the root of a user's ear may be a portion or structure of the ear that secures the ear to user's head. Also, as used herein, the term "outer ear" refers to the portion of the ear that is distal to the user's head as compared to the root of the ear. The outer ear may include or otherwise be defined by at least the ear's helix and ear lobule. Typically, the perimeter of the outer ear of an ear is greater than the perimeter of the root of the ear. The term "upper root portion of the ear" generally refers to a portion of the root of the ear that is proximal to the top of the user's head. In contrast, the term "lower root portion of the ear" refers to a portion of the root of the ear that is distal to the top of the user's head. Further, the terms "front of an ear" and "anterior portion of an ear" are used interchangeably and refer to a portion of the ear that is proximal to a user's face and distal to the back of the user's head. The front of the ear may include portions of the helix, the antihelix, tragus, and antitragus that are proximal to the user's face. The terms "back of an ear" and "posterior portion of an ear" are used interchangeably and refer to a portion of the ear that is proximal to the back of the user's head and distal to the user's face. The back of the ear may include portions of the helix and the antihelix proximal to the back of the user's head. Further descriptions and references to the foregoing terms are provided herein.

As generally described above, current attachment mechanisms used to secure wearable audio systems to users are often suboptimal. For example, some wearable audio systems implement a type of attachment mechanism commonly referred to as an "over-the-ear" design. A wearable audio system that utilize an over-the-ear design is worn by a user by placing ear cups of the wearable audio system over the ears of the user. The ear cups are both coupled to a headband positioned on the top or to the back of the user's head. The headband applies a compressive force to the user's head in order to secure the ear cups to the user. As a result, a user that uses an over-the-ear wearable audio system typically experiences constant pressure applied by the headband, often leading to headaches or general discomfort over time. This pressure is exaggerated in some over-the-ear wearable audio systems that attempt to form an acoustic seal against the user. Particularly, these wearable audio systems often attempt to form a tight seal around the user's ears by utilizing the headband to apply a substantial amount of pressure on the user to ensure that the seal around the ear cups is fully formed.

Other wearable audio systems are currently available, but these systems also utilize attachment mechanisms that have undesirable characteristics. For example, some wearable audio systems utilize a piece of support material that fits around the back of the user's ear to secure these systems to the user. In these systems, the support material hangs on or clamps onto the user's ear. This "behind-the-ear" attachment mechanism often causes user discomfort by chafing and pinching the user's skin. Because the entire weight of the wearable attachment system is applied to the user's ear via the support material, the user often experiences ear fatigue and general discomfort. Still other wearable audio systems are secured to users via insertion into users' ears canals. Often, such wearable audio systems cause users to experience discomfort over time by exerting a constant pressure against the ear canal walls. Further, while these systems acoustically isolate the inner ear from external sounds, the seal is formed inside the users' ear canals, leading to an increased risk that audio played from such systems will cause users to suffer hearing damage.

In overview, aspects of the present disclosure include attachment apparatuses and wearable audio systems that include attachment mechanisms that feature several improvements over current attachment mechanisms, such as those described above. Specifically, in some embodiments, an attachment apparatus may include an attachment body that defines an opening configured to enable a majority of a user's ear to pass through the opening when the attachment apparatus is coupled to the user. In such embodiments, the opening may include a first opening portion that enables an upper portion of the ear to pass through the opening and a second opening portion that enables a lower portion of the ear to pass through the opening. The attachment body may secure the attachment apparatus to an upper root portion of the user's ear received via the first opening portion and to a lower root portion of the user's ear received via the second opening portion.

In some embodiments, the attachment body may include a first attachment portion that prevents an anterior portion of the user's ear from passing through the opening formed from the attachment body. The first attachment portion of the attachment body may receive, from an interaction with the anterior portion of the ear, a force that biases the first attachment portion in a direction away from a median plane of the user. Because the first attachment portion of the attachment body is biased away from the user while the upper and lower portions of the user's ear are secured to the attachment apparatus, the attachment apparatus may be held secure against the user. Further, the force resulting from the interaction between the user's ear and the attachment body may be substantially distributed to at least the upper and lower portions of the user ear, thereby providing the user with a secure attachment to the attachment apparatus with comparatively less user discomfort than current attachment designs, such as those described above. In some embodiments, the biasing of the first attachment portion may bias a second attachment portion of the attachment body in a direction that is towards the median plane of the user. As such, the biasing force may cause the second attachment portion to press against or otherwise engage with the user's anatomy (e.g., the user's face or head). As such, when the attachment apparatus is coupled to the user's ear, the second attachment portion may form at least a partial acoustic seal against the user.

In some embodiments, the attachment apparatus may include a frame coupled to the attachment body. The frame may be configured to extend along at least a portion of a perimeter of the attachment body surrounding the opening defined by the attachment body. As such, the frame may substantially conform to a shape of the opening. The frame may be made from various elastic or non-elastic materials or combinations thereof. The frame may include at least a first frame portion and a second frame portion. While the attachment apparatus is coupled to the user's ear, the first frame portion may be configured to secure the attachment apparatus to the lower root portion of the user's ear, and the second frame portion may be configured to secure the attachment apparatus to the upper root portion of the user's ear. In such embodiments, the frame may be configured to apply a compressive force between the first and second frame portions when a tensile force is applied to the attachment body and/or to the frame. For example, the attachment body may be stretched, which may cause the opening to increase in size in at least one dimension. As a result, the larger opening may be suitable (or more suitable) for allowing the user's ear to pass through the opening. As a result of stretching the attachment body and/or the frame, the frame may transition from a resting configuration in which the frame exerts little or no compressive force on the attachment body to a deformed configuration in which the frame exerts compressive force (or a comparatively larger amount of compressive force) on the attachment body. This compressive force may be directed between the first and second frame portions, and as a result, the frame may be configured to return to the resting configuration when the tensile force is removed from the attachment body. Because the frame is coupled to the attachment body, the frame may also cause or urge the attachment body to compress when the tensile force is removed from the attachment body. As a result, the size of the opening is reduced such that the opening is configured to be more suitable for preventing the user's ear from passing back through the opening, thereby further securing the attachment apparatus to the user.

In some embodiments, the frame may be configured to bias a posterior portion of the user's ear away from the user's head while the attachment apparatus is secured to the user's ear. Specifically, in such embodiments, the frame may include a curved portion having a midsection that physically contacts and displaces the posterior portion of the user's ear, thereby biasing the user's ear in a direction away from the median plane of the user. Because the frame and/or the attachment body may be secured to upper and lower root portions of the user's ear, the interaction between the curved portion of the frame and the back portion of the user's ear may bias at least a portion of the attachment body towards the user, thereby forming or contributing to the formation of at least a partial acoustic seal against the user.

In some embodiments, the attachment apparatus may include a cover body coupled to the attachment body via a coupling edge included on the attachment body. In such embodiments, the cover body and the attachment body may define a cavity formed between the cover body and the attachment body. The cavity may be configured to accommodate the user's ear when the attachment apparatus is coupled to the user. Specifically, once the user's ear passes through the opening defined by the attachment body, the user's ear may remain substantially in the cavity formed between the attachment body and the cover body. In such embodiments, the attachment body and the cover body may collectively form an acoustic seal, entirely or substantially, around the user's ear. For example, the attachment body may engage the user to form a partial acoustic seal against the user, and the material structures of the cover body and the attachment body may prevent (or reduce) sound that is external to the cavity from reaching the user's ear.

In some embodiments, the attachment apparatus may be configured as a wearable audio system. In such embodiments, the cover body may include one or more audio components. By way of non-limiting examples, the audio components may include a speaker system, memory, a processing unit (e.g., a digital signal processor or central processing unit), a transceiver configured to receive audio data from external computing devices, or the like. The cover body may be coupled to the attachment body such that a speaker is positioned in proximity to an ear canal of the user's ear. Further, because the cover body and the attachment body may collectively form an acoustic seal around the user's ear, the attachment apparatus may provide the user with an exceptional audio experience because external sounds are blocked (or reduced) from reaching the user's ear when the attachment apparatus is secured to the user's ear.

Various embodiments will be described in detail with reference to the accompanying drawings. Wherever possible, the same reference numbers will be used throughout the drawings to refer to the same or like parts. References made to particular examples and implementations are for illustrative purposes and are not intended to limit the scope of the invention or the claims.

FIGS. 1A-1D illustrate exterior views of an attachment apparatus 100, according to some embodiments. The attachment apparatus 100 may include a plurality of features, including: an attachment body 101, a coupling edge 102, a front portion 104, a responsive portion 109, a biasing portion 110, and a back portion 106. The attachment apparatus 100 may also include an opening 108 defined by the attachment body 101, and the opening 108 may include a first opening portion 112 and a second opening portion 114. The various features of the attachment apparatus 100 are further described as follows.

FIG. 1A illustrates an exterior view of a front side of the attachment apparatus 100. In some embodiments, the attachment body 101 of the attachment apparatus 100 may be configured to define an opening 108 that is substantially positioned at a center of the attachment body 101. In some embodiments, the attachment body 101 may be configured such that the opening 108 defined by the attachment body 101 has a shape that approximates a profile of a root of a human ear, and may be referred to generally as a C-shape. The size and shape of the opening 108 may enable a majority of a human ear to pass through the opening. The size and shape of the attachment body 101 may also enable the majority of the ear to come into physical contact with one or more surfaces of the attachment body 101 (e.g., as further described with reference to FIGS. 2A-2C).

In some embodiments, the front portion 104 of the attachment body 101 may be configured to include the responsive portion 109 and the biasing portion 110. In some embodiments, the responsive portion 109 and the biasing portion 110 may be approximately defined based at least in part on a reference line 111 passing through the front portion 104. The biasing portion 110 and the responsive portion 109 may be configured to interact with the user's ear to secure the attachment apparatus 100 to the user's ear and, in some embodiments, to form at least a partial acoustic seal between the attachment apparatus 100 and the user's head. Forming at least a partial acoustic seal with the biasing portion 110 and the responsive portion 109 while the attachment apparatus 100 is coupled to a user is further described below (e.g., with reference to FIGS. 2A-2C).

In some embodiments, the first opening portion 112 and the second opening portion 114 may be separated (at least partially) by the biasing portion 110, which may extend or jut out from the front portion 104 into the opening 108. In some embodiments, the reference line 111 may be defined at least in part by the first opening portion 112 and the second opening portion 114. By way of an example, the reference line 111 may be defined based on points between the first opening portion 112 and the second opening portion 114 and, as such, may extend through the front portion 104 of the attachment body 101. In the example illustrated in FIG. 1A, the reference line 111 may pass approximately through a point on a recess of the front portion 104 in proximity to the first opening portion 112 and through a point on another recess of the front portion 104 in proximity to the second opening portion 114.

Once the attachment apparatus 100 is secured to the ear of the user, the shape of the first opening portion 112 may prevent or reduce clockwise rotation of the attachment apparatus 100. Similarly, the shape of the second opening portion 114 may prevent or reduce counterclockwise rotation of the attachment apparatus 100. Specifically, an upper portion of the user's ear may reside in the first opening portion 112, and in response to receiving a clockwise rotational force, the user's ear may engage the biasing portion 110, which may prevent the user's ear from beginning or continuing clockwise rotation. A lower portion of the user's ear may also reside in the second opening portion 112, and the user's ear may similarly be prevented from beginning or continuing counterclockwise rotation by the biasing portion 110. Thus, the configurations of the opening portions 112 and 114 may jointly prevent or substantially reduce any rotational movement of the attachment apparatus 100 around the user's ear.

The back portion 106 of the attachment body 101 may be configured to form a curved groove or channel between the opening 108 and the coupling edge 102. In some embodiments, the curved groove or channel of the back portion 106 may be configured to accommodate a posterior portion of the user's ear. For example, the back portion 106 may allow the posterior portion of the user's ear to sit within the curved groove or channel of the back portion 106 between the opening 108 and the coupling edge 102. Additionally, a surface of the posterior portion of the user's ear may be in physical contact with the back portion 106 while the attachment apparatus 100 is secured to the user. The groove or channel of the back portion 106 is further described herein (e.g., with reference to FIG. 1C).

In some embodiments, the front portion 104 and the back portion 106 may be configured such that the opening 108 is asymmetrical. For example, the second opening portion 114 may be larger than the first opening portion 112, or the first opening portion 112 may have a shape that is not symmetrical to the shape of the second opening portion 114. In some embodiments, the opening 108 may be configured to approximate the asymmetry of the human ear. In such embodiments, the opening 108 may accommodate the asymmetry of the human ear and, thus, may enable the user's ear to pass through the opening 108 easily. In some alternative embodiments (e.g., as described with reference to FIG. 3), the front portion 104 and the back portion 106 may be configured to define the opening 108 such that the first opening portion 112 is substantially symmetrical to the second opening portion 114.

The attachment body 101 may include the coupling edge 102, which may be configured to couple the attachment body to a cover body (e.g., as generally described with reference to FIGS. 5A-5C). The coupling edge 102 may be configured to have a perimeter around the attachment body 101 that is larger than the size or perimeter of the opening 108. In such embodiments, the perimeter of the coupling edge 102 may generally be larger than the outer ear of the user's ear so that the portion of the user's ear that passes through the opening is contained entirely within the attachment body 101.

In some optional embodiments, the attachment body 101 may be configured with a rounded edge 120 that extends along at least a portion of the perimeter of the opening 108. The rounded edge 120 may be configured to reduce or avoid angled or sharp edges around the opening 108. As such, the rounded edge 120 may reduce the overall impingement on the root of a user's ear and discomfort experienced by the user.

Figure 1B:
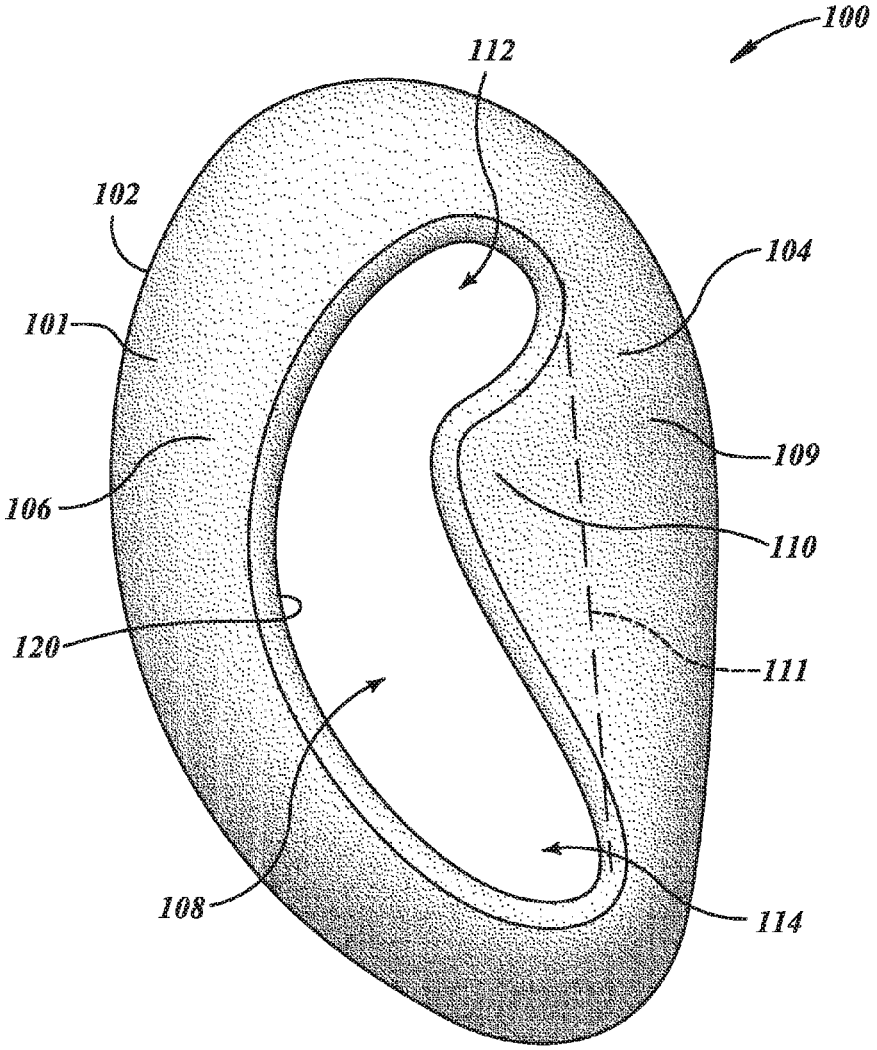
FIG. 1B is an exterior view of a back side of the attachment apparatus depicted in FIG. 1A, according to some embodiments.

FIG. 1B illustrates an exterior view of a back side of the attachment apparatus 100 described with reference to FIG. 1A, according to some embodiments. With reference to the example illustrated in FIG. 1B, the back surface of the attachment body 101 may be configured to engage physically with the user when the attachment apparatus 100 is coupled to the user. As such, the back of the attachment apparatus 100 may be generally configured to have a shape that conforms to a user's anatomy, such as a shape that contours to the general anatomy of a user's head around the user's ear. In some embodiments, a surface of the back of the attachment body 100 may be configured to come into contact with a surface of the user's anatomy in order to form at least a partial acoustic seal. By way of a non-limiting example, the attachment apparatus 100 may be secured to the user when a majority of the user's ear passes through the opening (e.g., as described with reference to FIG. 1A). Once the user's ear passes through the opening 108, the user's anatomy may come into physical contact with a back surface of the attachment body 101. In some embodiments, the back surface of the attachment body 101 may press against the user's anatomy, thereby forming at least a partial acoustic seal around the root of the user's ear.

Figure 1C:
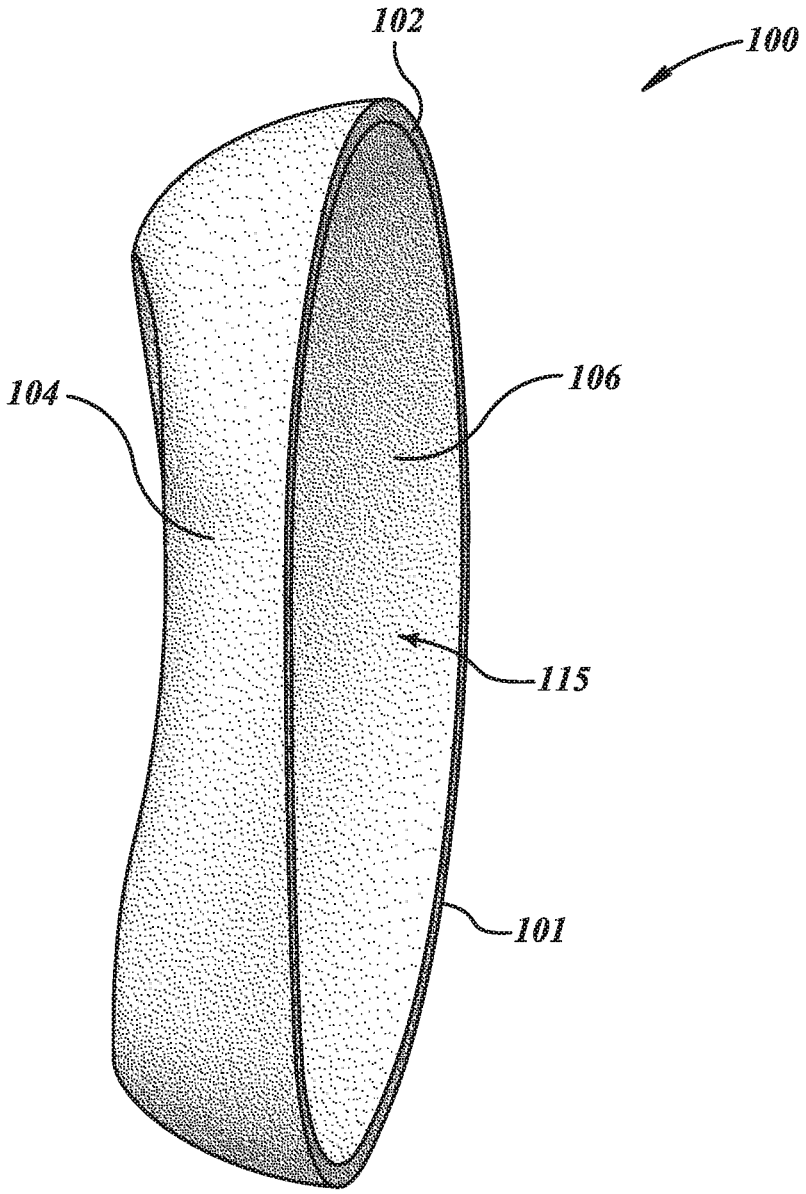
FIG. 1C is an exterior view of a left side of the attachment apparatus depicted in FIGS. 1A and 1B, according to some embodiments.
Figure 1D:
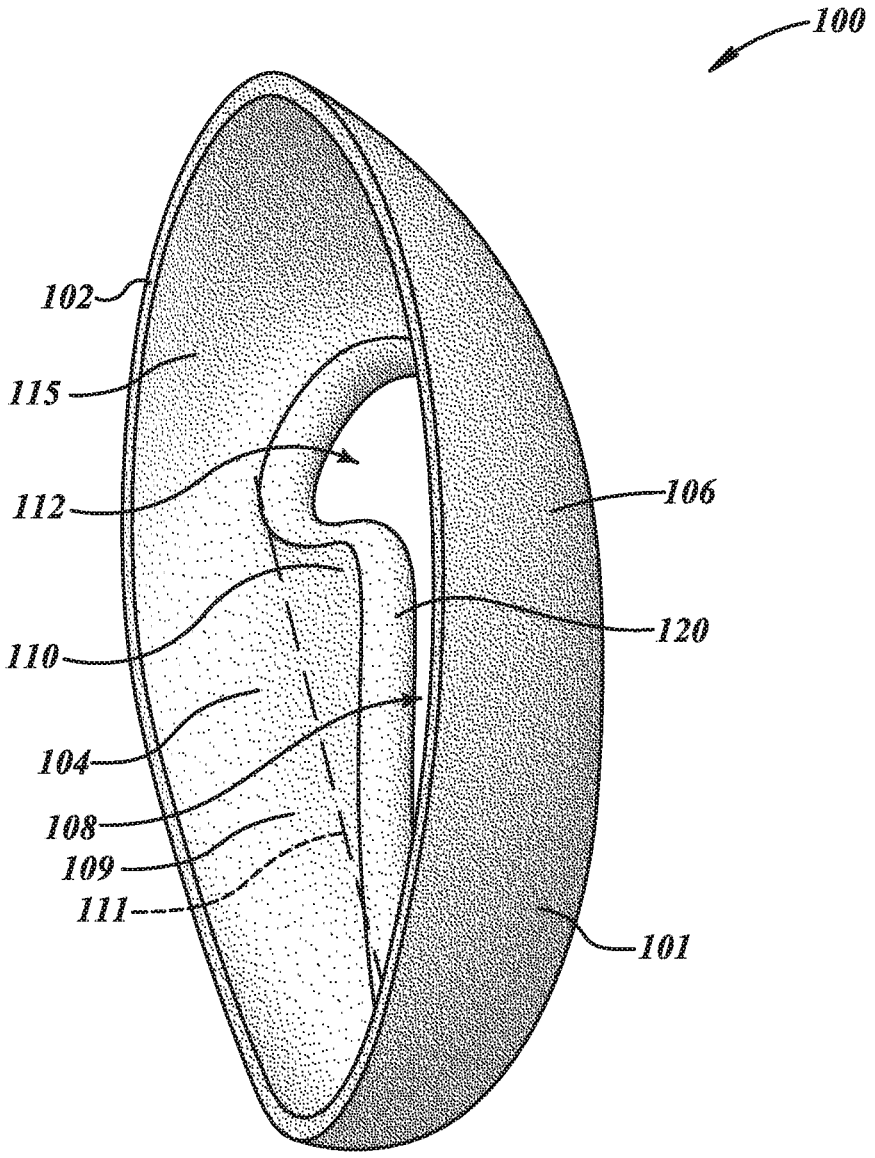
FIG. 1D is a perspective view of the attachment apparatus depicted in FIGS. 1A-1C, according to some embodiments.

FIGS. 1C and 1D illustrate exterior views of the attachment apparatus 100 described with reference to FIGS. 1A and 1B. Particularly, the examples illustrated in FIGS. 1C and 1D depict a curvature of the attachment body 101, according to some embodiments. In such embodiments, the back portion of the attachment body 101 proximal to the user (e.g., as described with reference to FIG. 1B) may be configured to have a concave shape suitable for accommodating the user's anatomy close to the user's ear. For example, the attachment body 101 may be configured to closely engage the user's head while the attachment apparatus 100 is secured to the user's ear. Further, as described, the back surface of the attachment body 101 may be configured to come into contact with a surface of the user's anatomy in order to form at least a partial acoustic seal. In such embodiments, the curvature of the attachment body 101 (e.g., as illustrated in FIG. 1C) may facilitate the formation of the at least partial acoustic seal around the user's ear. In some embodiments, when the attachment apparatus 100 is secured to the user, the front portion 104 of the attachment body 101 may extend in a direction away from the median plane of the user to a lesser extent than the extent to which the back portion 106 extends away from the user's median plane. In such embodiments, the back portion 106 may extend farther in order to accommodate the anatomy of the ear in which the back portion of the ear extends farther away from the user's head than the front portion of the user's ear. A depth of the front portion 104 may therefore be shorter than a depth of the back portion 106.

In some embodiments, the front portion 104 and the back portion 106 of the attachment body 101 may be configured to form a partial cavity 115 that may hold the user's ear when the attachment apparatus 100 is secured to the user. As described (e.g., with reference to FIG. 1A), the back portion 106 may be configured to form a groove or channel that supports or otherwise comes into physical contact with a surface of the posterior portion of the user's ear. Similarly, the front portion 104 may be configured to support, receive, or otherwise engage an anterior portion of the user's ear within the portion of the partial cavity 115 formed from the front portion 104. Further, in some embodiments (e.g. as shown in the example illustrated in FIG. 1D), the biasing portion 110 of the front portion 104 may be biased in a direction that is away from the median plane of the user when the attachment apparatus 100 is secured to the user. As such, the biasing portion 110 may be biased into the partial cavity 115.

Figure 2A:
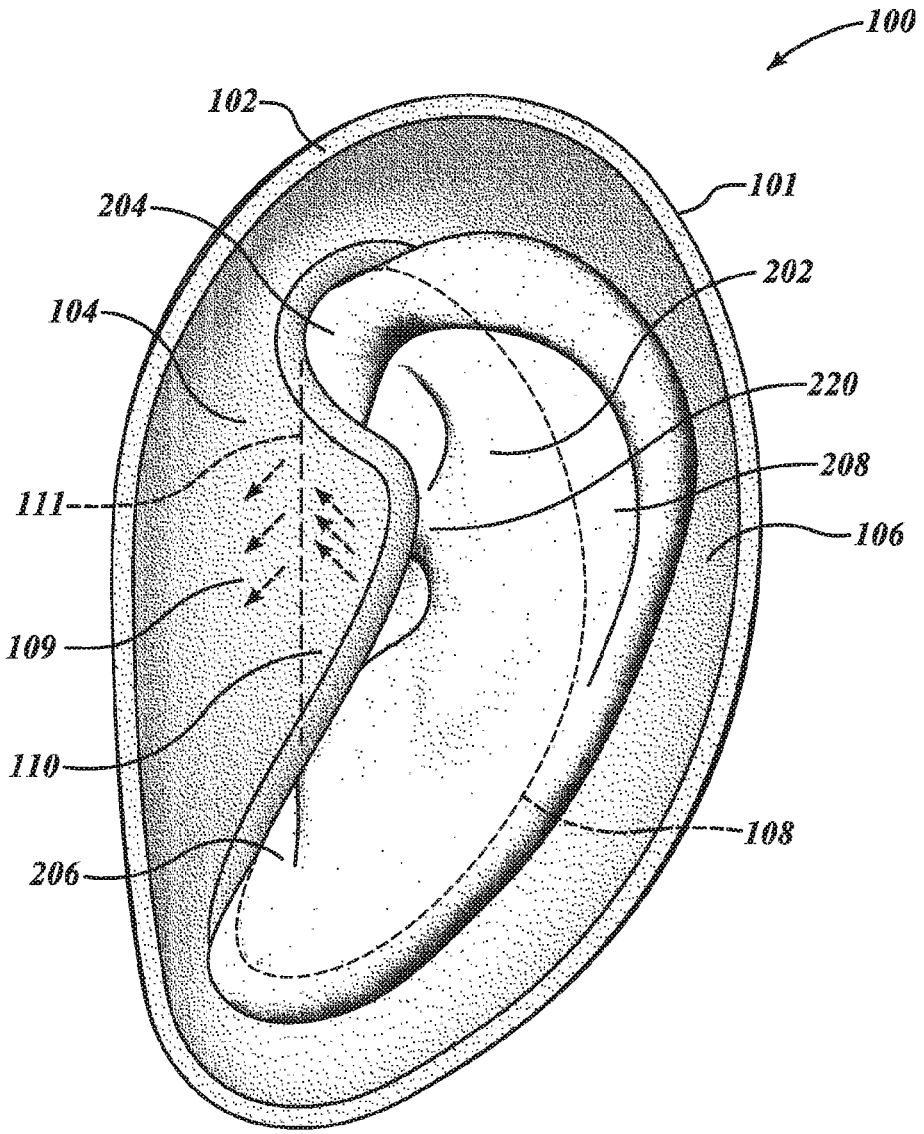
FIG. 2A is an exterior view of a front side of the apparatus depicted in FIG. 1A while secured to an ear of a user, according to some embodiments.
Figure 2B:
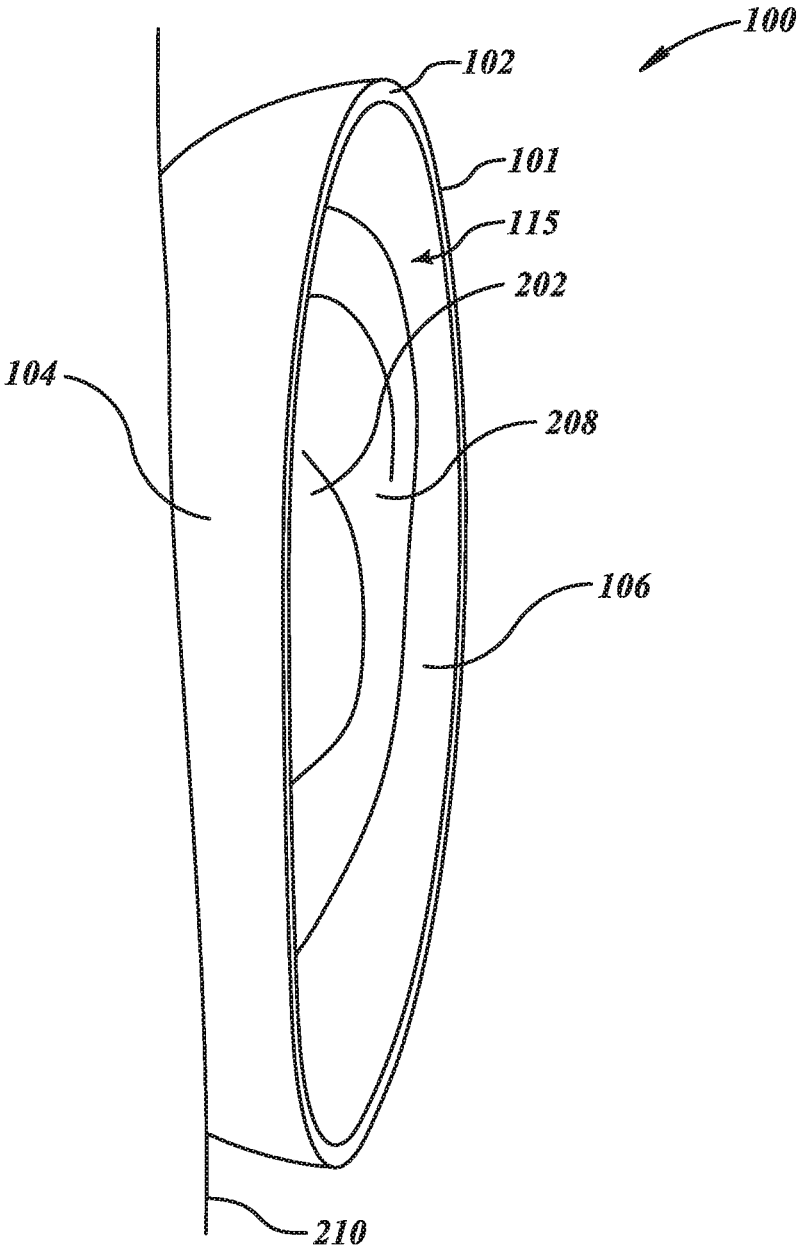
FIG. 2B is an exterior view of a left side of the attachment apparatus depicted in FIG. 2A, according to some embodiments.
Figure 2C:
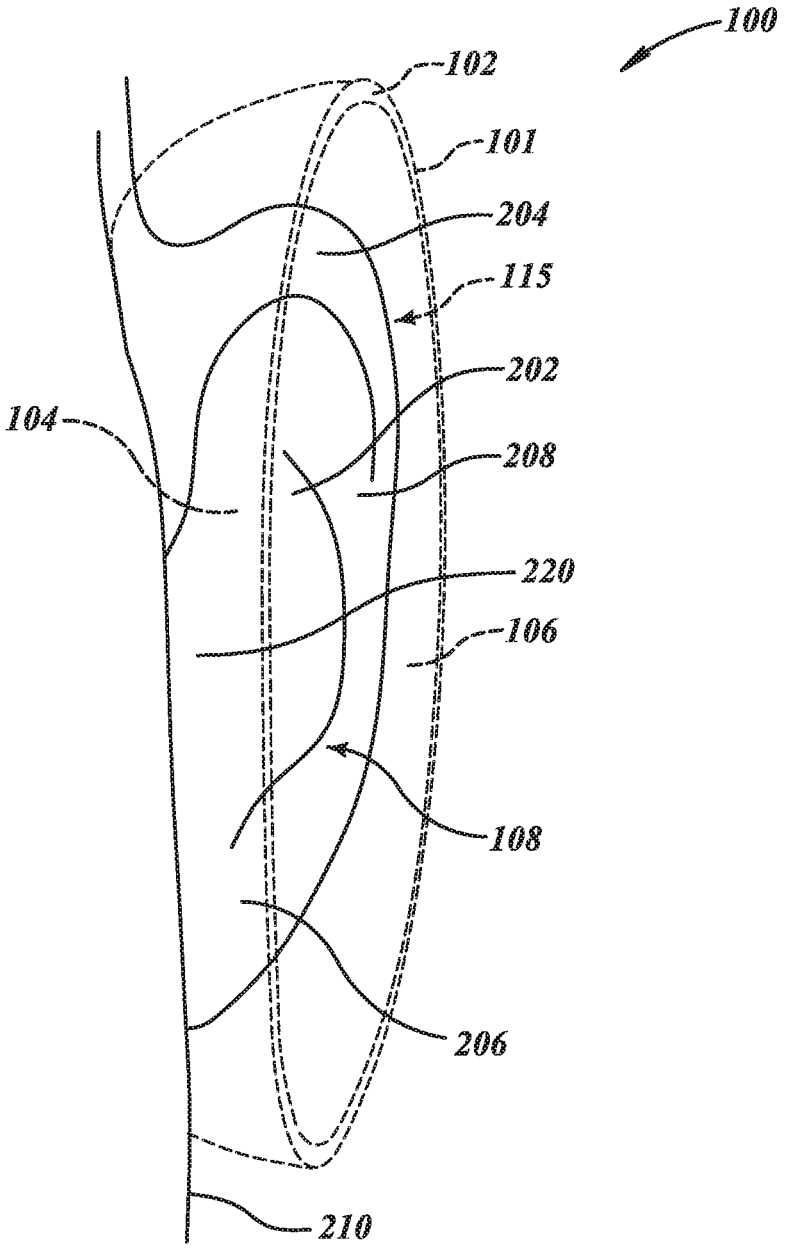
FIG. 2C is a semi-transparent exterior view of a left side of the attachment apparatus depicted in FIGS. 2A-2B, according to some embodiments.

FIGS. 2A-2C illustrate views of the attachment apparatus 100 described with reference to FIGS. 1A-1D when the attachment apparatus 100 is secured to a user's ear, according to some embodiments. In the examples illustrated in FIGS. 2A-2C, the user's ear 202 may include a posterior portion 208, an upper portion 204, a lower portion 206, and an anterior portion 220, as generally described herein.

FIG. 2A illustrates an exterior view of a front side of the attachment apparatus 100 after a majority of the ear 202 has passed through the opening 108. In some embodiments, the attachment body 101 may be at least partially made from a viscoelastic material. A force (e.g., a tensile force) may be applied to the attachment body 101 in order to transition the attachment body 101 from an initial or resting configuration to a deformed configuration. Specifically, a squeezing or stretching force applied to the top and bottom of the attachment body 101 may cause the opening 108 to enlarge or change shape to better accommodate the ear 202. The attachment body 101 may be further configured to revert to the resting configuration when the force applied to the attachment body 101 is removed. In some embodiments, the attachment body 101 (or a portion thereof) may be configured to revert to the resting configuration from the deformed configuration over a short period of time (e.g., three to five seconds) when the force applied to the attachment body 101 is removed. For example, a user may apply a pulling force on the attachment body 101 that causes the attachment body 101 to transition to a deformed configuration that better accommodates the ear 202. The user may remove the pulling force from the attachment body 101, which may cause the attachment body 101 to begin returning to the resting configuration slowly. Before the attachment body 101 returns to the resting configuration, the user may place the ear 202 through the opening 108, which may be elongated or otherwise deformed to accommodate passage of the user's ear 202 through the opening 108. Once the attachment apparatus 100 is secured to the user's ear 202, the attachment body 101 may continue transitioning back to the resting configuration, which may also cause the size of at least one dimension of the opening 108 to decrease. As such, once the attachment body 101 fully returns to the resting configuration, the opening 108 may have reduced in size, thereby securely attaching the attachment apparatus 100 to the user. In some embodiments, the attachment body 101 may form at least a partial acoustic seal around the user's ear 202 once the attachment body 101 returns to the resting configuration around the user's ear 202.

Additionally (or alternatively), the attachment body 101 may be configured to exert a compressive force of the user's ear, such as when the size of the opening 108 is smaller than a cross-sectional area of the root of the user's ear 202. In such embodiments, the root of the ear 202 may prevent the attachment body 101 from returning completely to the resting configuration when the attachment apparatus 100 is coupled to the ear 202. As such, the attachment body 101 may continuously apply a compressive force to the root of the ear 202 while the attachment apparatus 100 is coupled to the ear 202 that further secures the attachment apparatus 100 to the ear 202.

As depicted in the example illustrated in FIG. 2A, a majority of the user's ear 202 may have passed through the opening 108. Once coupled to the attachment apparatus 100, the posterior portion 208 of the ear 202 may be received or engaged by the back portion 106 of the attachment body 101. For example, a surface of the posterior portion 208 of the ear 202 may lay flush against the channel or groove formed from the back portion 106 of the attachment body 101. As described, the back portion 106 may be configured to contour to the general anatomical features of the posterior portion 208 of the ear 202 to enable the posterior portion 208 to fit comfortable with the attachment body 101. The lower portion 206 of the ear 202 may be received within at least the front portion 104 of the attachment body 101, such as shown in the example illustrated in FIG. 2A. Similarly, the upper portion 204 of the ear 202 may be received by the front portion 104 of the attachment body 101. Attachment of the attachment apparatus 100 to the upper portion 204 and lower portion 206 of the ear 202 is further described herein (e.g., with reference to FIG. 2C).

In some embodiments, the anterior portion 220 of the ear 202 may engage with or otherwise interact with the biasing portion 110 of the attachment body 101. Specifically, the anterior portion 220 of the ear may bias the biasing portion 110 in a direction that is away from a median plane of the user. In the example illustrated in FIG. 2A, the anterior portion 220 may cause the biasing portion 110 to flex with respect to the reference line 111 such that the biasing portion 110 is biased or displaced in a direction away from the anterior portion 220 of the ear 202. As a consequence, the biasing of the biasing portion 110 in relation to the reference line 111 may cause the responsive portion 109 of the attachment body 101 to be urged in a direction that is contrary to the direction in which the biasing portion 110 is biased (e.g., as illustrated by the dotted arrows in FIG. 2A). Thus, in some embodiments, the responsive portion 109 may be biased towards the user, thereby urging the responsive portion 109 to engage with a surface of the user (e.g., the side of the user's face). In some embodiments, the responsive portion 109 may form at least a partial acoustic seal when pressing against or otherwise engaging the user. Optionally, a surface of the responsive portion 109 of the attachment body 101 may be configured to include a texture or material that may increase an amount of friction that is created between the responsive portion 109 and the user, thereby improving the overall security of the attachment apparatus 100 to the user. For example, a surface of the responsive portion 109 may be configured to include one or more traction patterns that include ridges and/or recesses in the surface that may engage the surface of the user and that may increase the amount of friction generated between the surface of the responsive portion 109 and the surface of the user.

FIG. 2B illustrates an opaque view of a left side of the attachment apparatus 100 when the attachment apparatus 100 is secured to the ear 202 of the user. Once secured to the attachment apparatus 100, a majority of the ear 202 may reside, substantially or entirely, in the partial cavity 115 formed from the front portion 104 and back portion 106 of the attachment body 101. As described (e.g., with reference to FIG. 1C), the back portion 106 may generally accommodate the anatomical features of the posterior portion 208 of the ear 202. For example, a surface of the posterior portion 208 of the ear 202 may rest against the back portion 106 of the attachment body 101. Similarly, the anterior portion 220 of the ear 202 may engage with the front portion 104 of the attachment body 101, and bias the biasing portion 110 as described (e.g., with reference to FIG. 2A). In some embodiments, the front portion 104 and the back portion 106 may be configured such that the back portion 106 extends in a direction away from the median plane of the user farther than the extent to which the front portion 104 extends away from the median plane of the user. As such, in the view illustrated in FIG. 2B, the anterior portion 220 of the ear 202 may not be visible or may only be partially visible when viewed from the left side of the attachment apparatus 100. In contrast, the posterior portion 208 may be at least partially visible from the left side of the attachment apparatus 100 because the front portion 104 may not extend as far away from the user as the back portion 106 extends from the user.

In some embodiments, the front portion 104 may be configured to conform to the user. In the example illustrated in FIG. 2B, the front portion 104 may engage with the side of the face 210 of the user. As a result, the front portion 104 may be configured to contribute to securing the attachment apparatus 100 to the face 210 of the user via friction. Further, the front portion 104 may form or support the formation of at least a partial acoustic seal around the ear 202 of the user.

FIG. 2C illustrates a semi-transparent exterior view of the left side of the attachment apparatus 100 when the attachment apparatus 100 is secured to the ear 202 of the user. As described, the opening 108 may be configured to allow a majority of a user's ear 202 to pass through the opening. In some embodiments, a portion of the attachment body 101 that defines the first opening portion 112 may secure an upper root portion of the upper portion 204 of the ear 202. Similarly, another portion of the attachment body 101 that defines the second opening portion 114 may secure a lower root portion of a lower portion 206 of the ear 202. As such, when the majority of the user's ear 202 passes through the opening 108, the attachment apparatus 100 may be secured to the ear 202 at least by the portions of the attachment body 101 corresponding to the opening portions 112 and 114.

Various descriptions of the attachment apparatus 100 refer to the attachment body 101 being configured to include the front portion 104 and the back portion 106. These descriptions are merely for ease of description and do not require or imply that the front portion 104 and the back portion 106 of the attachment body 101 are separate components. Instead, in some embodiments, the attachment apparatus 101 may be configured as a single, continuous structure. However, in alternative embodiments, the front portion 104 and the back portion 106 of the attachment body 101 may be individual components that are joined together to form the attachment body 101.

Figure 3:
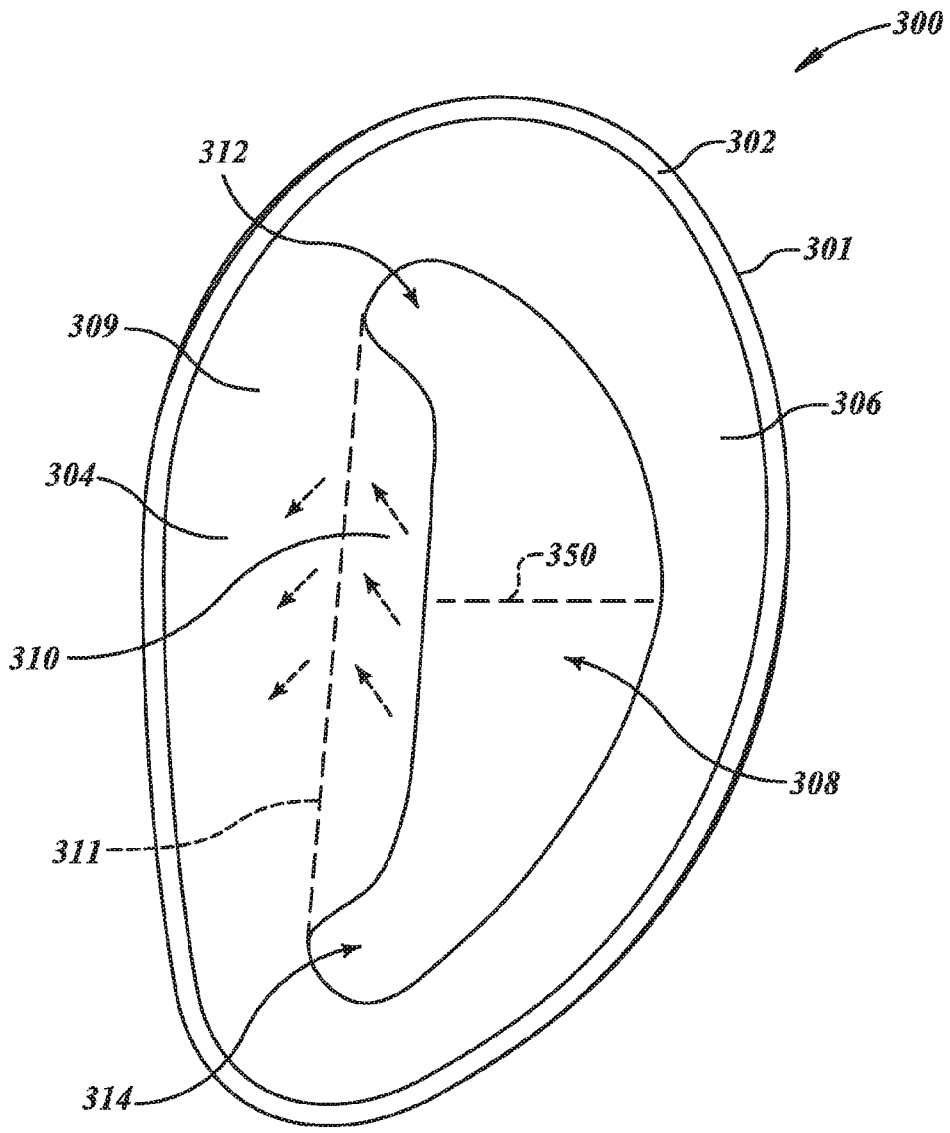
FIG. 3 is an exterior view of a front side of another attachment apparatus, according to some embodiments.

FIG. 3 illustrates a front view of an attachment apparatus 300, according to some alternative embodiments. The attachment apparatus 300 may include an attachment body 301, a coupling edge 302, a front portion 304, a back portion 306, and a responsive portion 309 and a biasing portion 310 formed in relation to a reference line 311. These features of the attachment apparatus 300 may function analogously to the components of the attachment apparatus 100 described above (e.g., with reference to FIGS. 1A-2C). For example, the front portion 304 and the back portion 306 of the attachment body 301 may define an opening 308 that includes a first opening portion 312 and a second opening portion 314. In some embodiments, the front portion 304 and the back portion 306 may be configured such that the opening 308 is substantially symmetrical in relation to an axis 350. For example, the opening 308 may be configured such that the first opening portion 312 and the second opening portion 314 are the same or substantially the same size.

In some embodiments, the opening 308 may enable a majority of a user's ear to pass through the opening 308. A posterior portion of the user's ear (not shown) may rest in a groove formed from the back portion 306 of the attachment body 301 and may be defined at least in part by the coupling edge 302. Additionally, an anterior portion of the user's ear (not shown) may interact with or engage the biasing portion 310 of the front portion 304, and bias the biasing portion 310 in a direction away from the median plane of the user when the attachment apparatus 300 is secured to the user. As a result, the biasing portion 310 may cause the responsive portion 309 to be urged in a direction towards the median plane of the user. For example, the responsive portion 309 may begin to press against the user in response to the biasing of the biasing portion 310, thereby forming at least a partial acoustic seal between the attachment body 301 and the user.

As described above, the front and back portions of the attachment body of the attachment apparatus may be configured to secure the attachment apparatus to a user's ear. However, in some embodiments, the attachment apparatus may include a frame that is configured to secure the attachment apparatus to a user alone or in combination with the attachment body.

Figure 4A:
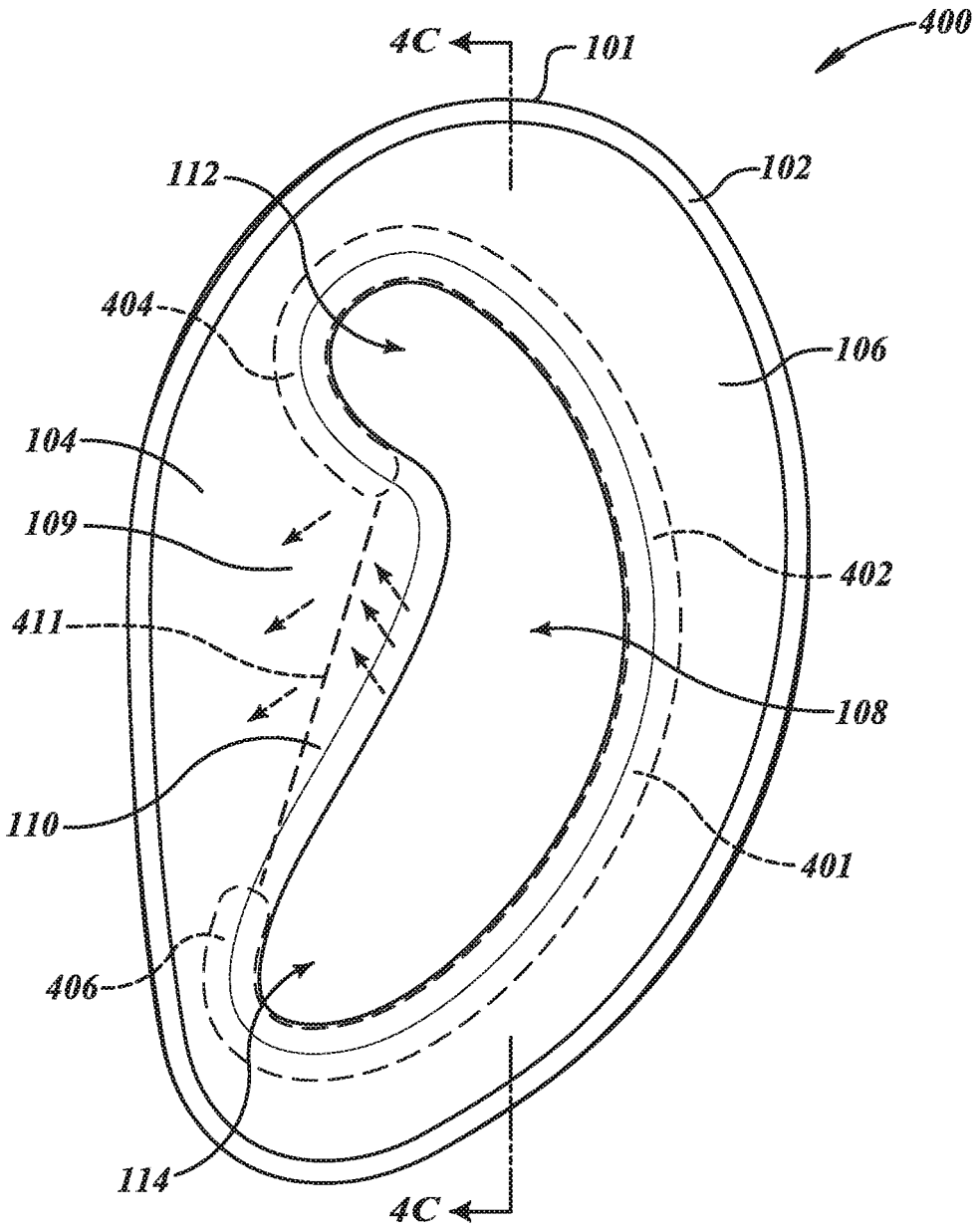
FIG. 4A is an exterior view of a front side of another attachment apparatus that includes a frame, according to some embodiments.
Figure 4B:
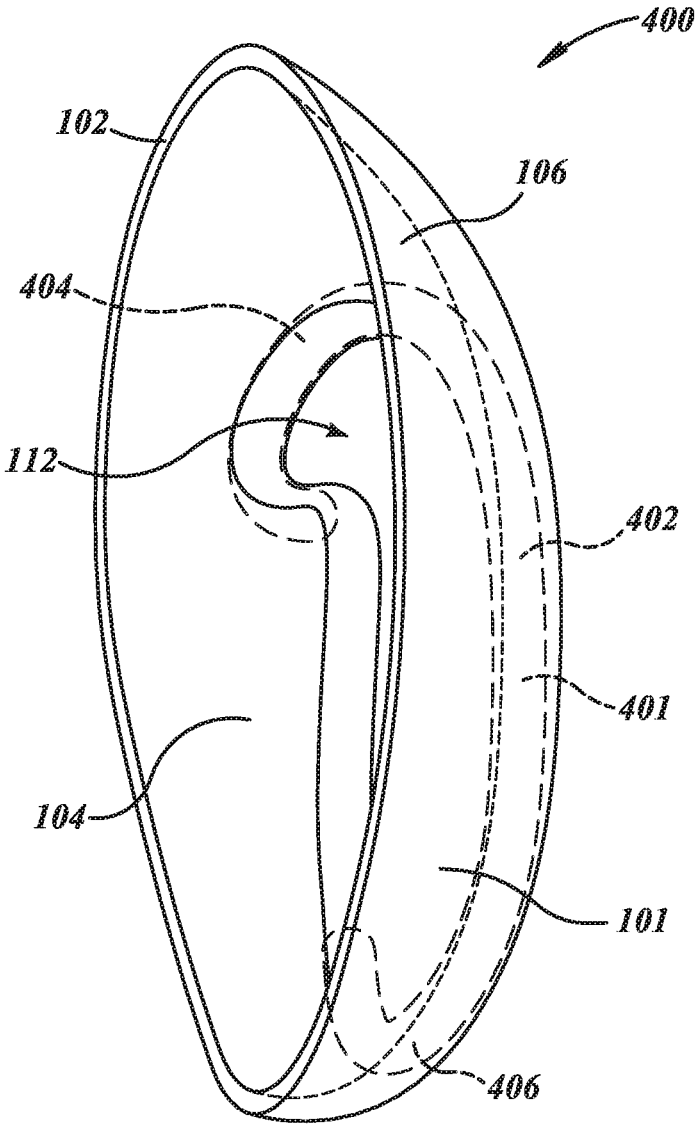
FIG. 4B is a semi-transparent perspective view of the attachment apparatus depicted in FIG. 4A, according to some embodiments.
Figure 4C:
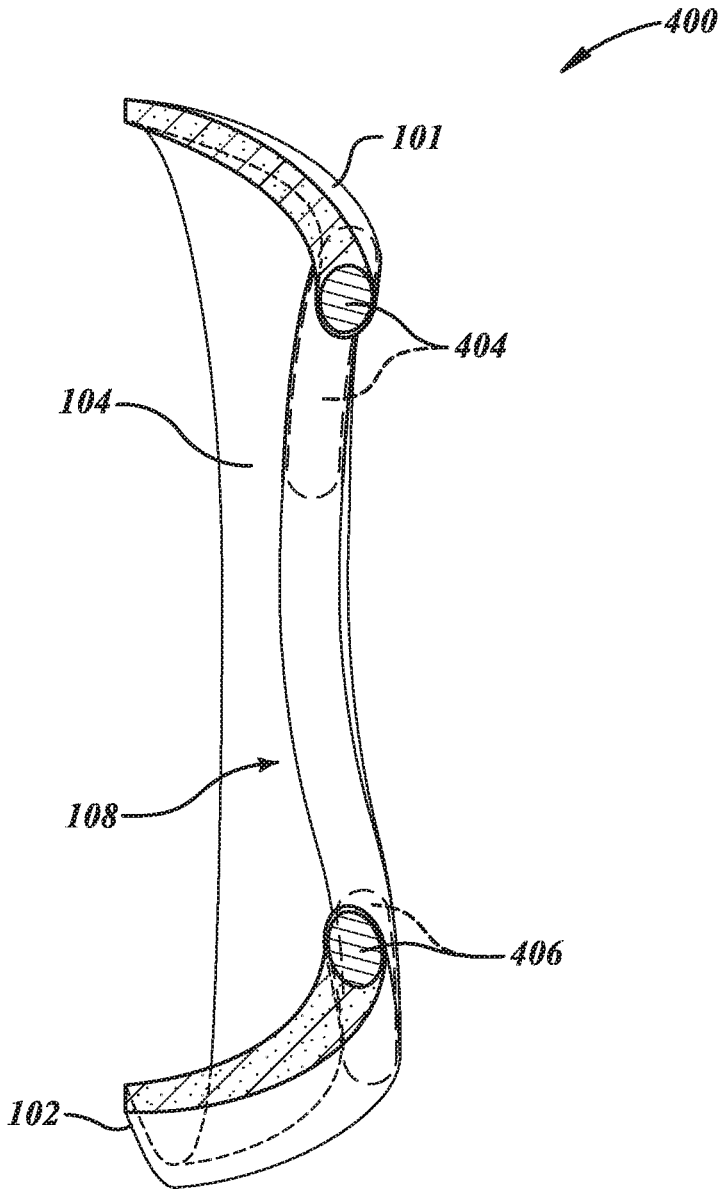
FIG. 4C is a semi-transparent, cross-sectional view of a right side of the attachment apparatus depicted in FIGS. 4A-4B taking along line 4C-4C in FIG. 4A, according to some embodiments.

FIGS. 4A-4C illustrate exterior views of an attachment apparatus 400, according to some embodiments. As shown in the examples of the attachment apparatus 400 illustrated in FIGS. 4A-4C, the attachment apparatus 400 may include a plurality of structural features that are similar to the structural features described with reference to the attachment apparatus 100 (e.g., as described with reference to FIGS. 1A-2C). The structural features include, but are not limited to, the attachment body 101, the coupling edge 102, the front portion 104 of the attachment body 101, the back portion 106 of the attachment body 101, the opening 108 defined by the front portion 104 and the back portion 106, and the first and second opening portions 112 and 114. Some of the structural features of the attachment apparatus 400 may be analogous to structural features described above, for example, with reference to the attachment apparatus 100. For clarity and simplicity of description, duplicative descriptions of such structural features of the attachment apparatus 400 may not be repeated in the following descriptions.

FIG. 4A illustrates an exterior view of a front of the attachment apparatus 400. The attachment apparatus 400 may include a frame 401 that is coupled to the attachment body 101. In some embodiments, the frame 401 may be coupled to a surface of the attachment body 101. Alternatively, the frame 401 may be partially or completely embedded into the attachment body 101, such by forming the attachment body 401 around the frame 401 via an overmolding process. In either event, the frame 401 is coupled to the attachment body 101. The frame 401 may be made from one or more materials, including hard or soft plastic, one or more metals, rubber, or a combination thereof. In some embodiments, the frame 401 may be made from an elastic or semi-elastic material, such as spring steel.

In some embodiments, the frame 401 may be configured to extend along at least a portion of the perimeter of the attachment body 101 surrounding the opening 108. In such embodiments, an interior facing portion of the frame 401 may substantially conform to the shape of the opening 108. In the example illustrated in FIG. 4A, the frame 401 may be configured to extend only partially around the perimeter of the attachment body 101 that surrounds the opening 108. However, in alternative embodiments (not shown), the frame 401 may be configured to extend around the entire perimeter of the attachment body 101 that surrounds the opening 108. In some embodiments, the frame 401 may include a first frame portion 404 and a second frame portion 406. The first frame portion 404 may be configured to follow a portion of the perimeter of the attachment body 101 surrounding the first opening portion 112. For example, the first frame portion 404 may be configured to curve such that the first frame portion 404 substantially or entirely surrounds the first opening portion 112. Similarly, the second frame portion 406 may be configured to follow a portion of the perimeter of the attachment body 101 surrounding the second cutout portion 114. In such embodiments, the first frame portion 404 and the second frame portion 406 may be separated by a portion of the front portion 104 of the attachment body 101. For example, the first frame portion 404 and the second frame portion 406 may be separated by at least some of the responsive portion 109 and the biasing portion 110 of the front portion 104.

In some embodiments, the first frame portion 404 may be configured to secure the attachment apparatus 400 to an upper root portion of the user's ear. Likewise, the second frame portion 406 may be configured to secure the attachment apparatus 400 to a lower root portion of the user's ear. A back portion 402 of the frame 401 may be configured to secure the attachment apparatus to a root of a posterior portion of the user's ear. In this configuration, the frame 401 may at least partially secure the attachment apparatus 400 to the user's ear, and a surface of the posterior portion of the user's ear may rest against the back portion 106 of the attachment body 101 (e.g., as described with reference to FIG. 1A).

In some embodiments in which the attachment body 101 is coupled to the frame 401, the responsive portion 109 and the biasing portion 110 may be defined at least in part based on a reference line 411 (e.g., as illustrated in FIG. 4A as a dotted line). The reference line 411 may correspond to a line between an end of the first frame portion 404 and an end of the second frame portion 406. In such embodiments, when the user's ear is coupled to the attachment apparatus 400, the anterior portion of the user's ear may interact with or otherwise engage with the biasing portion 110 of the attachment body 101. This interaction may bias the biasing portion 110 in a direction away from the median plane of the user, and in turn, may cause the responsive portion 109 to be urged in a direction towards the median plane of the user. As described, the biasing of the responsive portion 109 may cause the responsive portion 109 to press against the user, forming or contributing to the formation of at least a partial acoustic seal between the attachment body 101 and the user.

As described, the attachment body 101 may be configured to transition from a resting configuration to a deformed configuration, such as in response to applying a tensile force on the attachment body 101 and/or the frame 401. In some embodiments, while the attachment body 101 is in the deformed configuration, the frame 401 may be configured to be in a continuous state of tension in which the first frame portion 404 and the second frame portion 406 pull towards each other. Accordingly, the frame 401 may be configured to bias the attachment body 101 toward a resting configuration when the attachment body 101 is in a deformed configuration. For example, the user may apply a pulling force on the attachment body 101 that causes the attachment body 101 to transition into a deformed configuration in which a size of the opening 108 has increased or has otherwise changed to accommodate passage of the user's ear through the opening 108 better. While the size of the opening 108 is enlarged, the user may insert the user's ear through the opening 108. Once the user's ear is received into the opening 108 and the user removes the tensile force applied to the attachment body 101 and/or the frame 401, the frame 401 may bias the attachment body 101 toward the resting configuration. Because the size of the opening 108 while the attachment body 101 is in the resting configuration may be smaller than the size of the opening 108 while the attachment body 101 is in the deformed configuration, the frame 401 may cause the size of the opening 108 to decrease, thereby securing the attachment apparatus 400 to the user's ear. In some embodiments, while the attachment body 101 is in the resting configuration, the frame 401 (and/or the attachment body 101) may apply a slight compressive force to the user's ear, thereby further securing the attachment apparatus 400 to the user's ear.

As described, the first frame portion 404 may be configured to secure the attachment apparatus 400 to the upper root portion of the user's ear, and the second frame portion 406 may be configured to secure the attachment apparatus 400 to the lower root portion of the user's ear. In some embodiments, the first frame portion 404 may be configured to engage the upper root portion of the user's ear so that clockwise rotation of the attachment apparatus 400 around the user's ear is reduced or prevented. Similarly, the second frame portion 406 may be configured to engage the lower root portion of the user's ear so that counterclockwise rotation of the attachment apparatus 400 around the user's ear is reduced or prevented. Accordingly, in such embodiments, the combination of the first and second frame portions 404 and 406 may be configured jointly to reduce movement of the attachment apparatus 400 around the user's ear, thereby contributing to a more secure attachment.

With reference to the examples illustrated in FIGS. 4B and 4C, the frame 401 may be configured to conform to a curve of the attachment body 101. Specifically, the frame 401 may be configured to accommodate the shape of the anatomy of the user's ear, for example, as depicted in the exterior view of the right side of the attachment apparatus 400, as illustrated in FIG. 4C. In such embodiments, the curvature of the frame 401 may enable the frame 401 to form a more secure attachment between the attachment apparatus 400 and the user's ear because the frame 401 closely follows the contours of the root of the user's ear. Further, because the frame 401 accommodates the shape of the root of the user's ear, the frame 401 may better enable the attachment body 101 to form at least a partial acoustic seal with the user when the attachment apparatus 400 is coupled to the user.

Figure 5A:
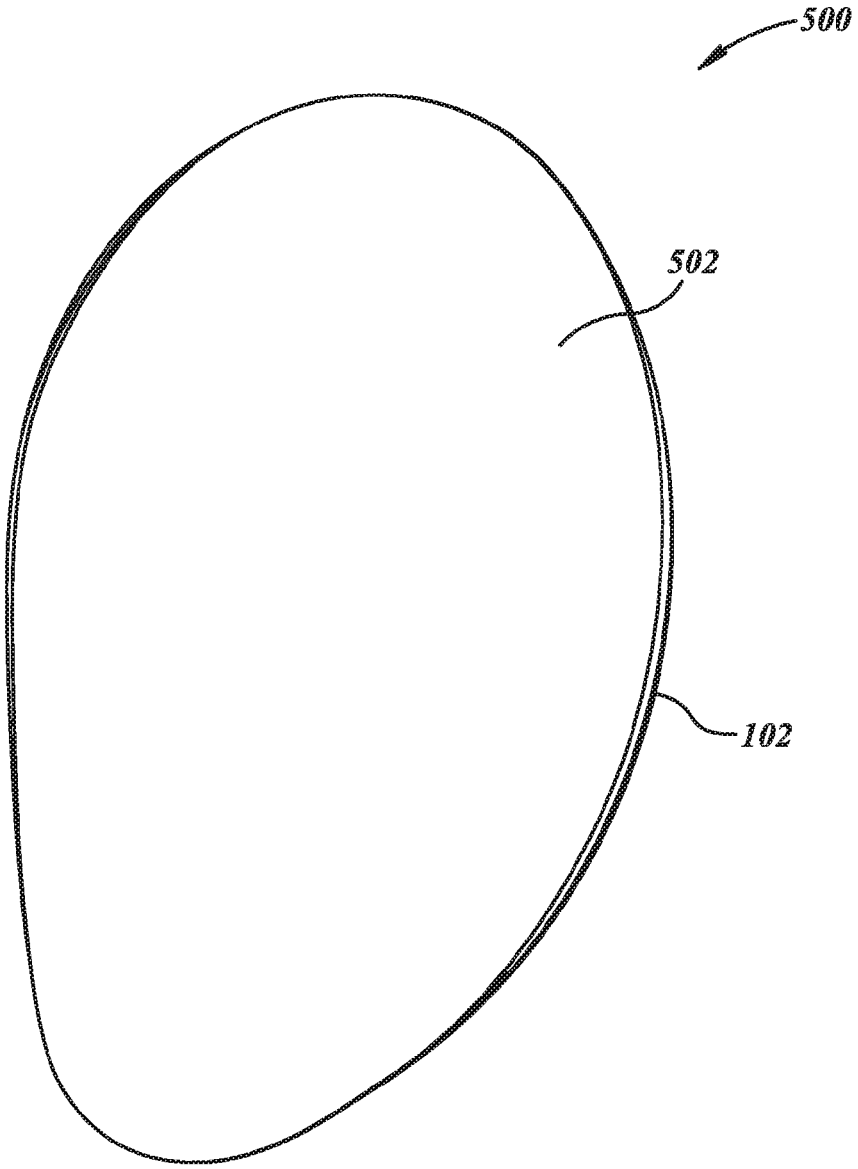
FIG. 5A is an exterior view of a front side of another attachment apparatus that includes a cover body, according to some embodiments.
Figure 5B:
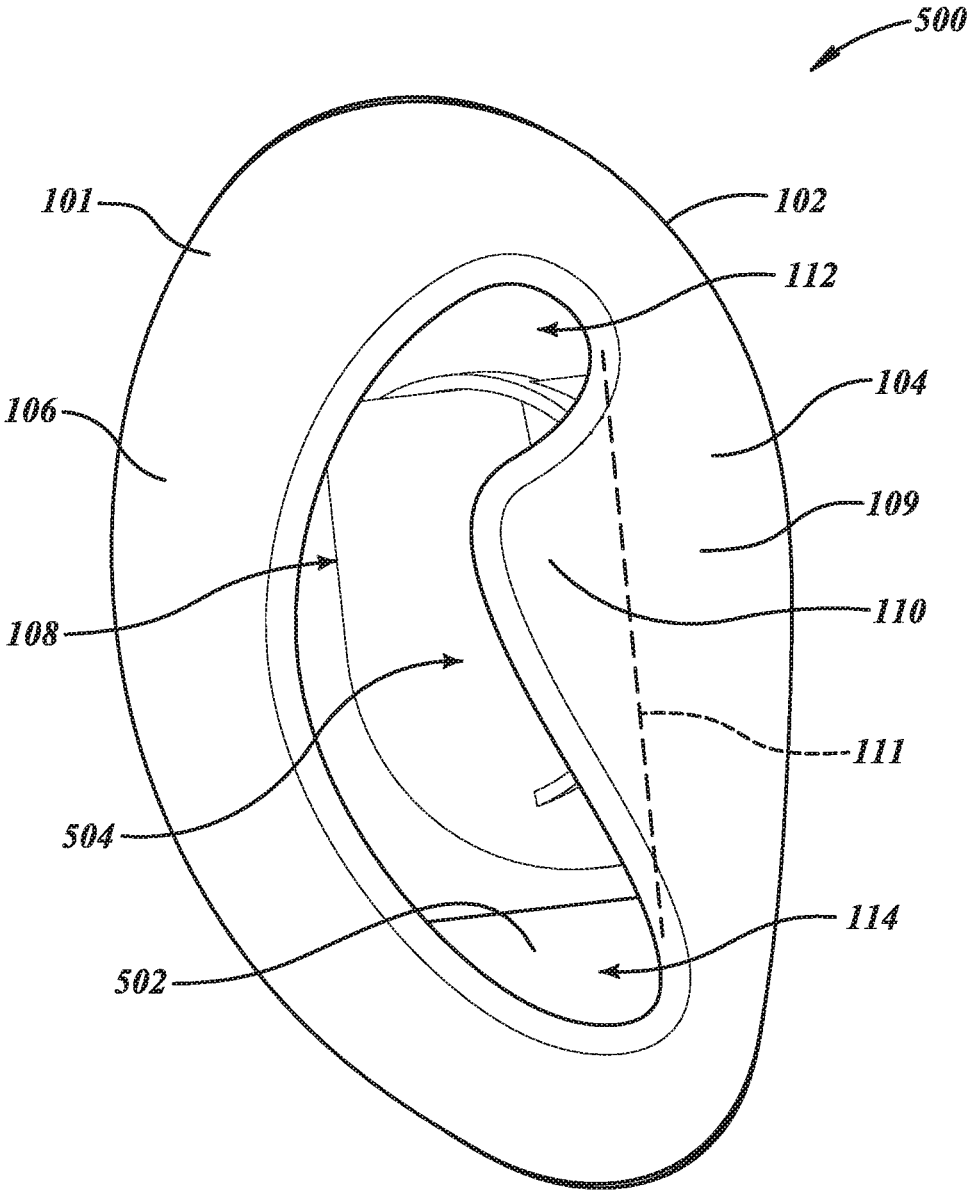
FIG. 5B is an exterior view of a back side of the attachment apparatus depicted in FIG. 5A, according to some embodiments.
Figure 5C:
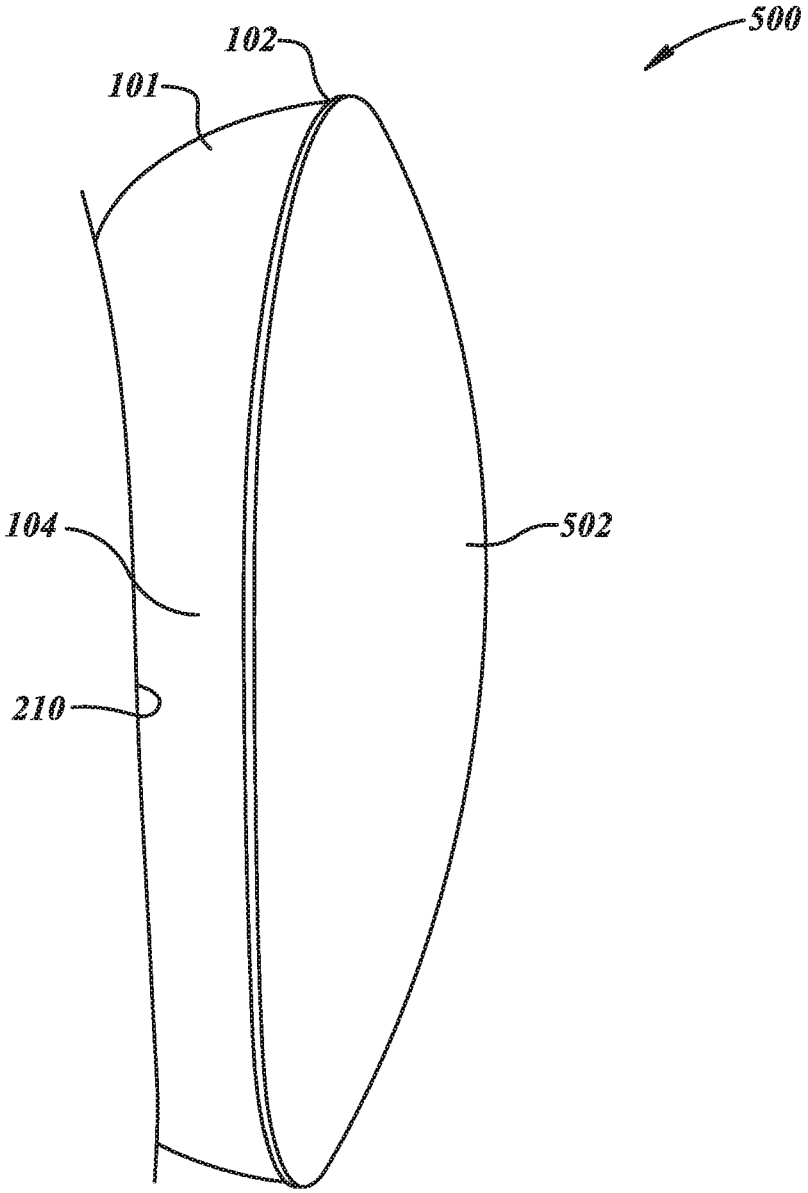
FIG. 5C is an exterior view of a left side of the attachment apparatus depicted in FIGS. 5A-5B, according to some embodiments.

FIGS. 5A-5C illustrate exterior views of an attachment apparatus 500, according to some embodiments. As shown in the examples of the attachment apparatus 500 illustrated in FIGS. 5A-5C, the attachment apparatus 500 may include one or more structural features that are similar to the structural features described with reference to the attachment apparatus 100 and/or the attachment apparatus 400 (e.g., as described with reference to FIGS. 1A-4C). Specifically, in some embodiments, the attachment apparatus 500 may include, but is not limited to including, the attachment body 101, the coupling edge 102, the front portion 104 of the attachment body 101, the back portion 106 of the attachment body 101, the opening 108 defined by the front portion 104 and the back portion 106, and the first and second opening portions 112 and 114. Some of the structural features of the attachment apparatus 500 may be analogous to structural features described above, for example, with reference to the attachment apparatuses 100 and/or 400. For clarity and simplicity of description, duplicative descriptions of such structural features of the attachment apparatus 500 may not be repeated in the following descriptions.

FIG. 5A illustrates an exterior view of a front side of the attachment apparatus 500. The attachment apparatus 500 may include a cover body 502 that is coupled to the attachment body 101 (not shown) via the coupling edge 102. The cover body may be made from one or more materials, including hard or soft plastic, ceramic, one or more metals, rubber, or a combination thereof. In some embodiments, the cover body 502 may be configured to have a shape that substantially conforms to a shape of the coupling edge 102. As such, the cover body 502 may be configured to have a shape that approximates the shape of an outer ear of a human ear.

FIG. 5B illustrates a back view of the attachment apparatus 500. In the example illustrated in FIG. 5B, the attachment apparatus 500 may include the opening 108 defined by the front portion 104 and the back portion 106 of the attachment body 101. The opening 108 may be configured similarly to the opening 108 described above (e.g., with reference to FIGS. 1A-4C). As such, the opening 108 may be configured to enable a majority of a user's ear to pass through the opening and may enable the attachment body 101 to secure the attachment apparatus 500 to the user. In some embodiments, the attachment body 101 and the cover body 502 may be joined to form a cavity 504 between the attachment body 101 and the cover body 502. In such embodiments, the cavity 504 may be configured to encapsulate the user's ear when the attachment apparatus 500 is secured to the user's ear. As described, the attachment body 101 may press against or otherwise engage the user to form at least a partial acoustic seal around the user's ear. In some embodiments, in addition to the at least partial acoustic seal formed between the attachment body 101 and the user, the cover body 502 and the attachment body 101 collectively be configured to reduce or block exterior sound from passing into the cavity 504. As such, the cavity 504 may be configured as a substantially or completely acoustically isolated space when the attachment apparatus 500 is secured to the user's ear. This acoustic isolation is further described with reference to FIGS. 6A-6D.

FIG. 5C illustrates an exterior view of a left side of the attachment apparatus 500, according to some embodiments. In some embodiments, the cover body 502 may cover the coupling edge 102 of the attachment body 101, and the cover body 502 may be coupled to, fastened to, joined to, or otherwise engaged with the coupling edge 102 via one or more attachment methods. For example, the cover body 502 may be bonded to the coupling edge 102 via adhesives or may be fastened to the coupling edge 102 via one or more interlocking members (not shown) or other fastening devices or techniques. According to such embodiments, the cover body 502 and the attachment body 101 may be coupled together in such a way that the cavity 504 formed between the cover body 502 and the attachment body 101 is substantially acoustically isolated when the attachment body 101 engages the user while the attachment apparatus 500 is secured to the user.

Figure 6A:
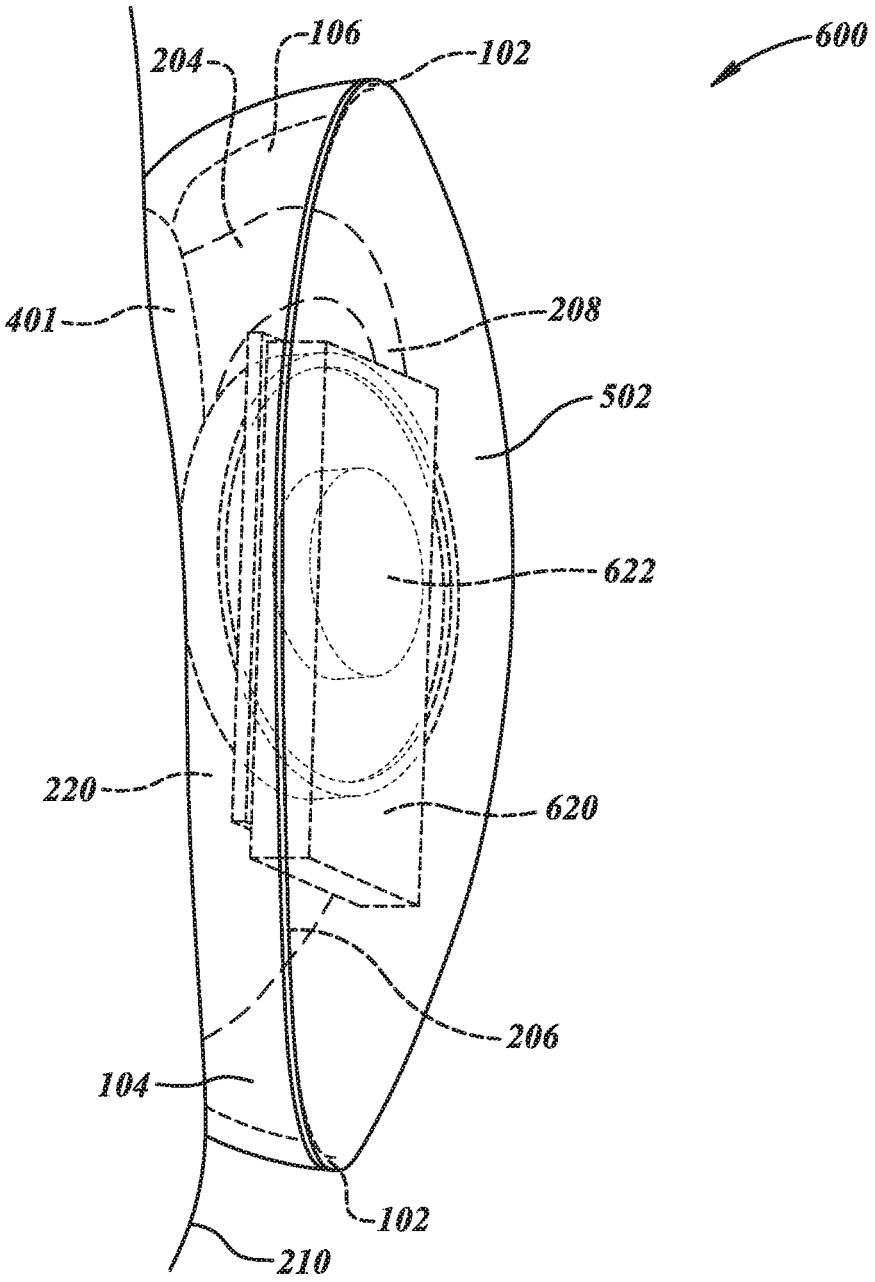
FIG. 6A is a semi-transparent, exterior view of a left side of another attachment apparatus configured as a wearable audio system, according to some embodiments.
Figure 6B:
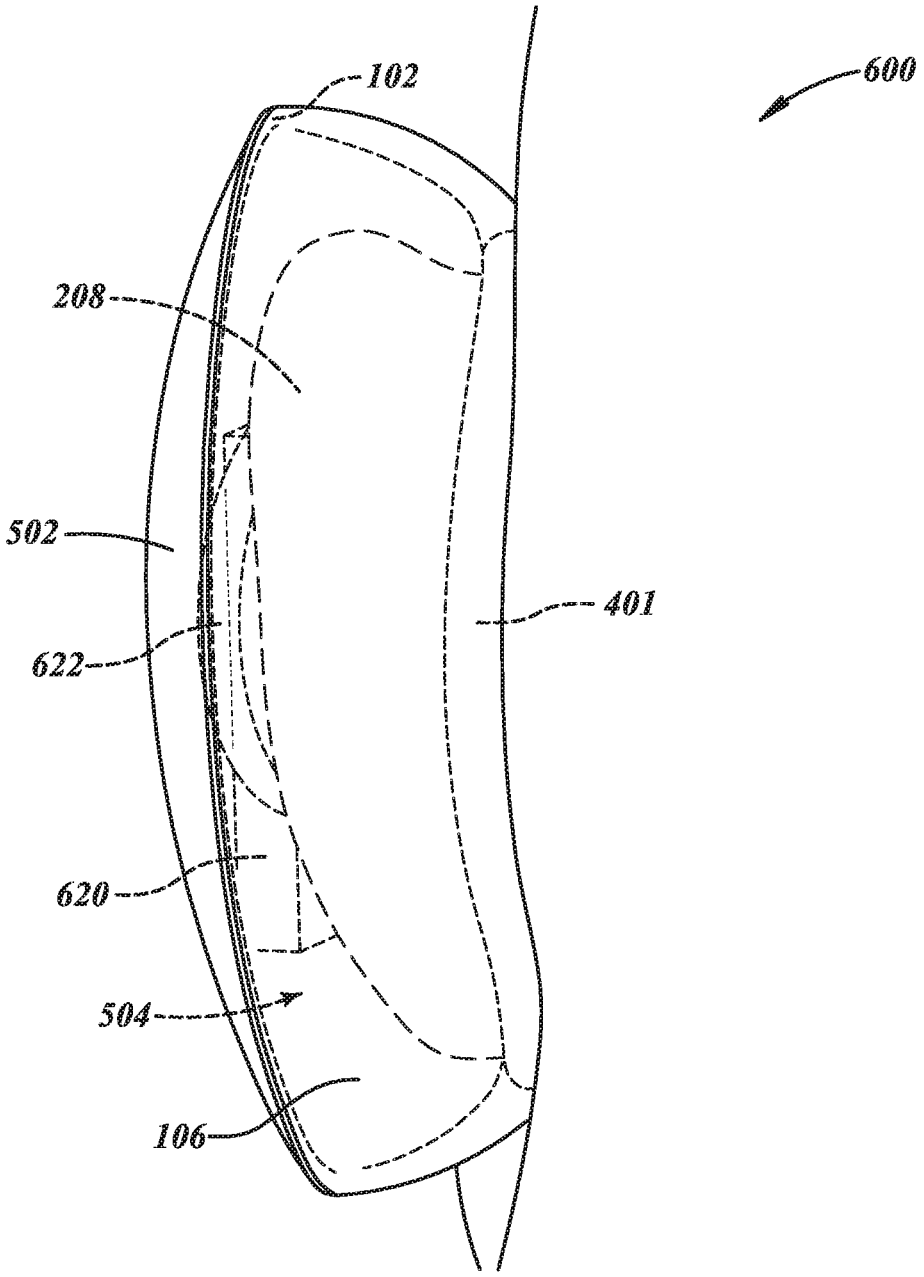
FIG. 6B is a semi-transparent, exterior view of a right side of the attachment apparatus depicted in FIG. 6A, according to some embodiments.

FIGS. 6A-6B illustrate alternative views of an attachment apparatus 600 configured as a wearable audio system, according to some embodiments. As shown in the examples of the attachment apparatus 600 illustrated in FIGS. 6A-6B, the attachment apparatus 600 may include one or more structural features that are similar to the structural features described above (e.g., with reference to the attachment apparatuses 100, 400, and/or 500 illustrated in FIGS. 1A-4C). Specifically, in some embodiments, the attachment apparatus 600 may include, but is not limited to including, the attachment body 101, the coupling edge 102, the front portion 104 of the attachment body 101, the back portion 106 of the attachment body 101, the opening 108 defined by the front portion 104 and the back portion 106, the first and second opening portions 112 and 114, and the cover body 502. Some of the structural features of the attachment apparatus 600 may be analogous to structural features described above, for example, with reference to the attachment apparatuses 100, 400, and/or 500. For clarity and simplicity of description, duplicative descriptions of such structural features of the attachment apparatus 600 may not be repeated in the following descriptions.

FIG. 6A illustrates a semi-transparent, exterior view of a left side of the attachment apparatus 600. In some embodiments, the cover body 502 may incorporate or otherwise include one or more audio components that may enable the attachment apparatus 600 to function as a wearable audio system. In such embodiments, the cover body 502 may include one or more audio components 620. The one or more audio components 620 may include, without limitation, a flexible circuit or printed circuit board, memory, a power source (e.g., a battery), a transceiver for receiving audio signals from an exterior computing device, a processing unit, a signal processor, an amplifier, or the like. Further, the cover body 502 may include a speaker system 622 that may be configured to play audio into the cavity 504 formed between the attachment body 101 and the cover body 502. In some embodiments (not shown), the cover body 502 may include an input device, such as a capacitance touch screen. In such embodiments, the cover body 502 may be configured to receive a touch input from a user, and the touch input may be provided to one or more processing components included in the cover body 502 (e.g., a processing unit or the like). For example, the cover body 502 may receive a touch input that causes the processing unit to stop, start, or change audio that is played out through a speaker included in the cover body 502.

In the example illustrated in FIG. 6A, the audio components 620 and/or the speaker system 622 may be positioned within a portion of the cavity 504 in proximity to the ear 202 of the user. For example, when the attachment apparatus 600 is secured to the user's ear, the speaker system 622 may be positioned in close proximity to the anterior portion 220 of the ear 202 (e.g., close to an ear canal of the ear 202) so that audio played through the speaker system is directed towards the ear canal. In such embodiments, the speaker system 622 may be positioned at an angle that intersects with the median plane of the user in order to direct sound into the ear canal of the ear 202. In some embodiments, the attachment apparatus 600 may include the frame 401 as described (e.g., with reference to FIGS. 4A-4C). Specifically, the frame 401 may secure the attachment apparatus 600 to the root of the upper portion 204 of the ear 202 and to root of the lower portion 206 of the ear 202.

FIG. 6B illustrates a semi-transparent, exterior view of a right side of the attachment apparatus 600, according to some embodiments. In the example illustrated in FIG. 6B, the frame 401 may secure, at least in part, the attachment apparatus 600 to the root of the back portion 208 of the user's ear 202. As such, when the attachment apparatus 600 is secured to the ear 202, the ear 202 may be encapsulated in the cavity 504 formed between the cover body 502 and the attachment body 101. As further illustrated in this example, the cover body 502 may be configured to include the one or more audio components 620 and the speaker system 622. As shown, the speaker system 622 may be positioned relative to the ear 202 such that the speaker system 622 is capable of playing audio that is directed to the ear canal of the ear 202.

FIGS. 7A-7D illustrate alternative views of an attachment apparatus 700 configured to include an alternative frame design, according to some embodiments. As shown in the examples of the attachment apparatus 700 illustrated in FIGS. 7A-7D, the attachment apparatus 700 may include one or more structural features that are similar to the structural features described above (e.g., with reference to the attachment apparatuses 100, 400, 500, and/or 600 illustrated in FIGS. 1A-6B). Specifically, in some embodiments, the attachment apparatus 700 may include, but is not limited to including, the attachment body 101, the coupling edge 102, the front portion 104 of the attachment body 101, the back portion 106 of the attachment body 101, and the cover body 502. In some embodiments (not shown), the attachment apparatus 700 may further include the opening 108 defined by the front portion 104 and the back portion 106 and the first and second opening portions 112 and 114. Some of the structural features of the attachment apparatus 700 may be analogous to structural features described above, for example, with reference to the attachment apparatuses 100, 400, 500, and/or 600. For clarity and simplicity of description, duplicative descriptions of such structural features of the attachment apparatus 700 may not be repeated in the following descriptions.

Figure 7A:
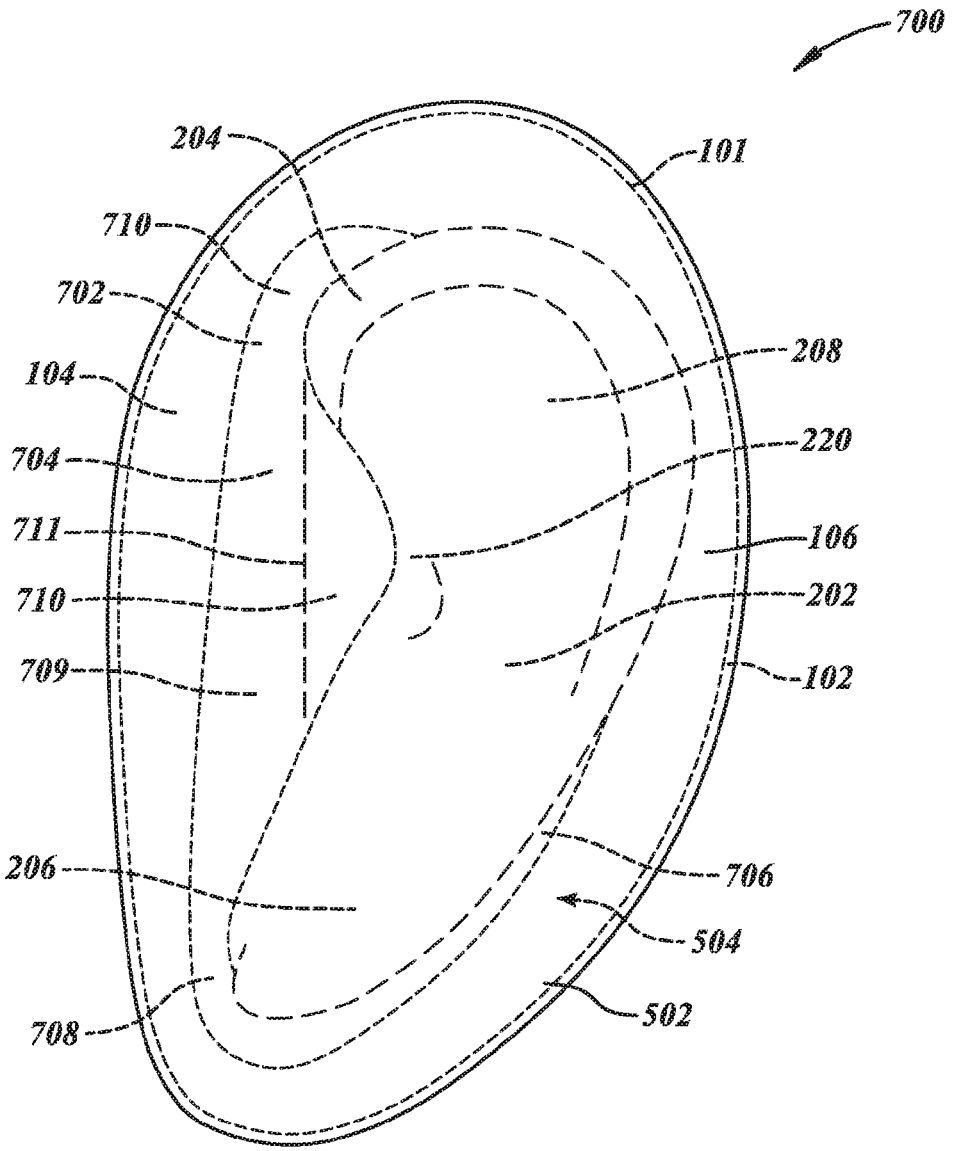
FIG. 7A is a semi-transparent, exterior view of a front side of another attachment apparatus secured to an ear of a user, according to some embodiments.

FIG. 7A illustrates a semi-transparent, exterior view of a front side of the attachment apparatus 700. In some embodiments, the attachment body 101 of the attachment apparatus 700 may be coupled to a frame 702. The frame 702 may be coupled to a surface of the attachment body 101 or may be partially or completely embedded in the attachment body 101. In either event, the frame 401 is coupled to the attachment body 101. The frame 702 may extend along at least a portion of a perimeter portion of the attachment body 101 that surrounds an ear-shaped opening (not shown) formed in the attachment body. In such embodiments, the frame may substantially conform to the shape of the opening. In the example illustrated in FIG. 7A, the frame 702 may extend along the entirety of the opening such that the frame 702 may be configured to engage with all or substantially all of the root of the ear 202 that is inserted through the opening.

In some embodiments, the frame 702 may be made from one or more rigid or semi-rigid materials or combinations of these materials. For example, the frame 702 may be made from hard plastic or rubber. In some embodiments, the frame 702 may be made from at least partially elastic materials or combination of at least partially elastic materials. For example, the frame 702 (or at least a portion thereof) may be made from spring steel. In some embodiments, the materials comprising the frame 702 may have a hardness or a modulus of elasticity that is greater than a hardness or a modulus of elasticity of the materials comprising the attachment body 101.

In some embodiments, the frame may include a top frame portion 710, a bottom frame portion 708, and a back frame portion 706. While the attachment apparatus 700 is secured to the user's ear 202, the top frame portion 710 of the frame 702 may be configured to secure the attachment apparatus 700 to the root of the upper portion 204 of the ear 202. The bottom frame portion 710 of the frame 702 may be configured to secure the attachment apparatus 700 to the root of the lower portion 204 of the ear 202. The back frame portion 706 may be configured to secure the attachment apparatus 700 to a root of the posterior portion 208 of the ear 202. In such embodiments, the frame 702 may be configured to apply a compressive force between the top frame portion 710 and the bottom frame portion 708 (and, in some embodiments, the back frame portion 706) when the attachment body 101 receives a tensile force. For example, the attachment body 101 may be stretched in order to configure the opening (not shown) to be larger in size and thus more suitable for allowing the user's ear 202 to pass through the opening. As a result of stretching the attachment body 101, the frame 702 may transition from a resting configuration in which the frame 702 exerts little or no compressive force on the attachment body 101 to a deformed configuration in which the frame 702 exerts compressive force (or a comparatively larger amount of compressive force) on the attachment body 101. This compressive force may be directed between the top frame portion 710 and the bottom frame portion 708. As a result, the frame 702 may be configured to return to the resting configuration when the tensile force is removed from the attachment body 101. Because the frame 702 is coupled to the attachment body 101, the frame 702 may also cause the attachment body 101 to compress when the tensile force is removed from the attachment body 101, thereby reducing the size of the opening formed in the attachment body 101 to be suitable for preventing the user's ear 202 from passing back through the opening.

In some embodiments, the frame may include a front portion 704 that may be configured to engage the anterior portion 220 of the ear 202. The front portion 704 may include a biasing portion 710 and a responsive portion 709 that are respectively defined at least in part by a reference line 711 that extends through the front portion 704 of the frame 702. In some embodiments, the biasing portion 710 and the responsive portion 709 may interact with the anterior portion 220 of the ear 202 in order to secure the attachment apparatus 700 to the user, as further described with reference to FIG. 7D.

Figure 7B:
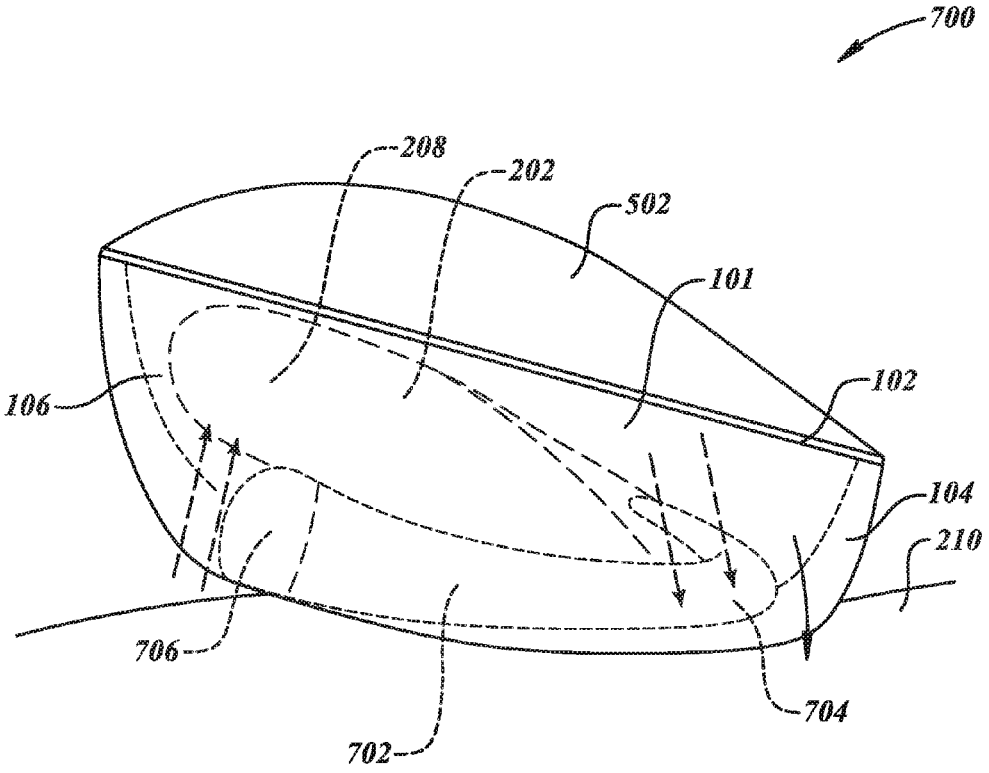
FIG. 7B is a semi-transparent, topside view of the attachment apparatus depicted in FIG. 7A, according to some embodiments.

FIG. 7B illustrates a semi-transparent, top-down view of the attachment apparatus 700. In some embodiments, the frame 702 may be configured such that the back frame portion 706 includes a midsection that curves away from the head of the user and that curves towards a back surface of the posterior portion 208 of the ear 202. According to this configuration, the curvature of the back frame portion 706 may displace the posterior portion 208 of the ear 202 in a direction that is away from a median plane of the user while the attachment apparatus 700 is secured to the user's ear 202. As illustrated by the dotted arrowed, the interaction of the posterior portion 208 of the ear 202 and the back frame portion 706 may bias the front portion 704 of the frame 702 in a direction towards the median plane of the user. Because the frame 702 is coupled to the attachment body 101, the biasing of the frame 702 may similarly bias the front portion 104 of the attachment body 101 in a direction that causes the front portion 104 of the attachment body 101 to engage with the user. For example, the front portion 104 may press against the face of the user 210, thereby forming or contributing to the formation of at least a partial acoustic seal against the user.

Figure 7C:
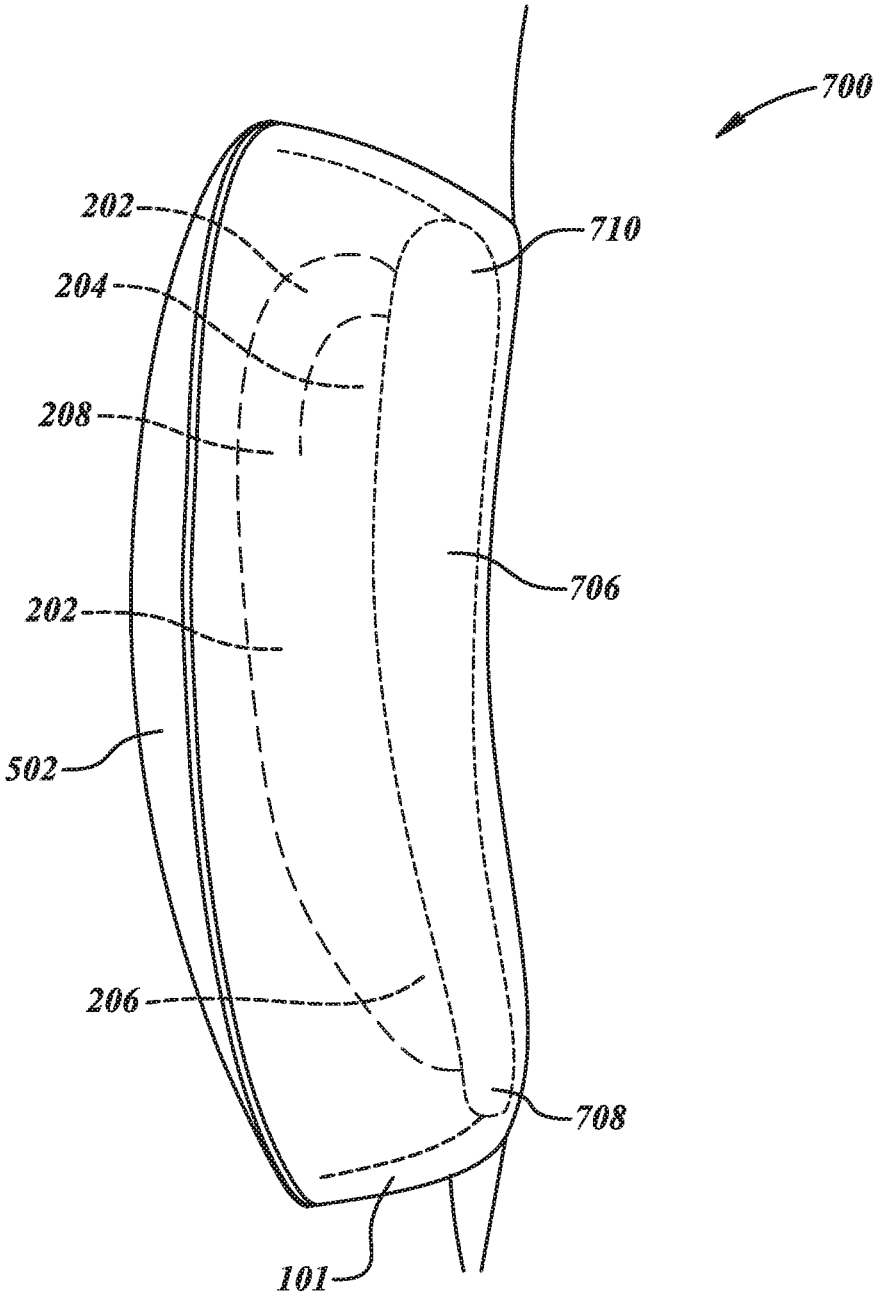
FIG. 7C is a semi-transparent, exterior view of a right side of the attachment apparatus depicted in FIGS. 7A-7B, according to some embodiments.

FIG. 7C illustrates a semi-transparent, exterior view of a right side of the attachment apparatus 700, according to some embodiments. The example illustrated in FIG. 7C depicts the curvature of the back frame portion 706. As described (e.g., with reference to FIG. 7B), the back frame portion 706 may be configured to have a midsection that curves towards a back surface of the posterior portion 208 of the ear 202 in order to displace the posterior portion 208 of the ear 202. In some embodiments, the midsection of the back frame portion 706 may engage the posterior portion 208 of the ear 202 while the upper frame portion 710 and the lower frame portion 708 engage the upper root portion 204 of the ear 202 and the lower root portion 206 of the ear 202, respectively. Thus, according to this configuration, the frame 702 may securely attach the attachment apparatus 700 to the ear 202 while displacing the posterior portion 208 of the ear to form a secure acoustic seal, as described above.

Figure 7D:
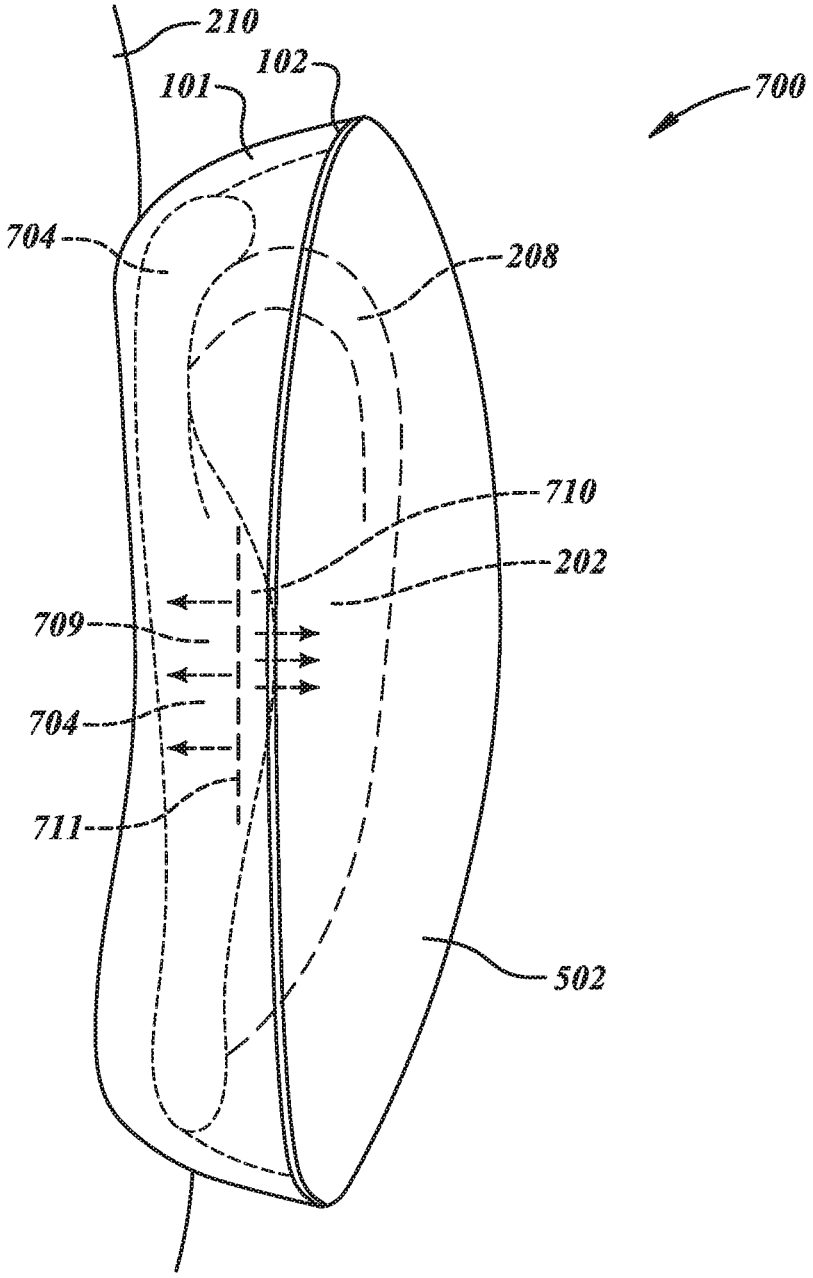
FIG. 7D is a semi-transparent, exterior view of a left side of the attachment apparatus depicted in FIGS. 7A-7C, according to some embodiments.

FIG. 7D illustrates a semi-transparent, exterior view of a left side of the attachment apparatus 700, according to some embodiments. As described, the frame 702 may include the front frame portion 704 that includes a biasing portion 710 and the responsive portion 709. In such embodiments, the biasing portion 710 of the frame 702 may be configured to engage with or otherwise interact with an anterior portion 220 of the ear 202. In particular, the anterior portion 220 of the ear 202 may bias the biasing portion 710 of the frame 702 in a direction that is away from the median plane of the user. This biasing of the biasing portion 710 may cause the responsive portion 709 of the frame 702 to be urged in a direction towards the median plane of the user. As a result, the responsive portion 709 of the frame 702 may cause the front portion 104 of the attachment body 101 to press against the user—such as along the face 210 of the user—, thereby forming or contributing to the formation of at least a partial acoustic seal between the attachment body 101 and the user. Further, once secured in the attachment apparatus 700, the ear 202 may reside in the cavity 504 formed between the attachment body 101 and the cover body 502. In some embodiments, the posterior portion 208 of the ear 202 may engage the back portion 106 of the attachment body 101, such as by resting a surface of the posterior portion 208 of the ear 202 against a surface of the back portion 106 of the attachment body 101.

In some embodiments (not shown), the attachment apparatus 700 may be configured as a wearable audio system. In such embodiments, the cover body 502 may include one or more audio components, speaker systems, or the like as generally described above, for example, with reference to the attachment apparatus 600 (see FIGS. 6A and 6B).

Examples illustrated in the accompanying drawings may depict one or more embodiments of the attachment apparatus as being configured for use with a left ear of a user. However, any descriptions or illustrations of the foregoing attachment apparatuses that cause the attachment apparatus to be suitable for use with a left ear of a user are made merely for ease of description. As such, unless otherwise limited by the claims, there is no requirement that the attachment apparatuses described above must be configured for use only with left ears. For example, without loss of generality, any of the above attachment apparatuses may be configured to couple to a right ear of a user by mirroring the structures described and illustrated above. Further, in some embodiments (not shown), any of the various attachment apparatuses described above may be utilized with a mirrored attachment apparatus that is configured to function on an opposite ear. In such embodiments, an attachment apparatus and a mirrored attachment apparatus may operate together as part of a single audio system because the attachment apparatus may be configured for use with one ear of the user, and the mirrored attachment apparatus may be coupled for use with the other ear (or vice versa). For example, in some embodiments in which the attachment apparatus and the mirrored attachment apparatus are configured as wearable audio systems, the user may utilize the attachment apparatus and the mirrored attachment apparatus together to experience stereophonic sounds in which an audio source is played simultaneously or nearly simultaneously through both the attachment apparatus and the mirrored attachment apparatus.

Figure 8:
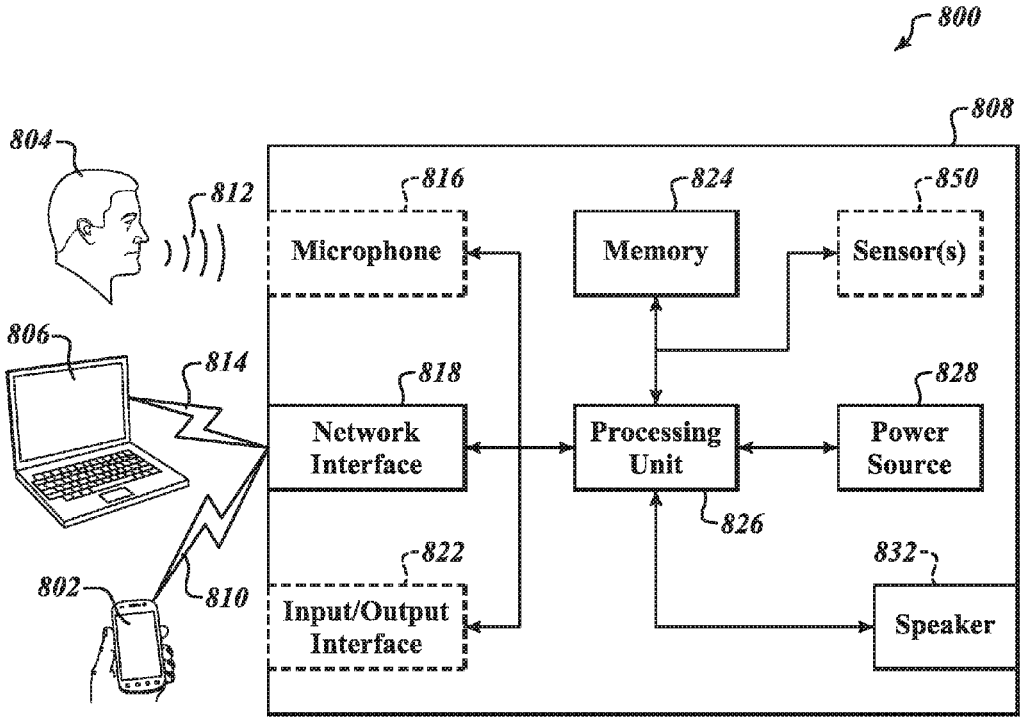
FIG. 8 is a communication system diagram illustrating an attachment apparatus configured as a wearable audio system, according to some embodiments.

FIG. 8 is a functional block diagram of an illustrative operating environment 800 suitable for implementing aspects of the present disclosure. The operating environment 800 includes an attachment apparatus 808 that may be configured to receive audio data from various sources, including a mobile computing device 802, an analog source of sound 804 (e.g., a human), or another computing device 806.

The example illustrated in FIG. 8 depicts a general architecture of the attachment apparatus 808 that may be configured to playout audio, among other functions. The general architecture of the attachment apparatus 808 includes an arrangement of computer hardware and/or software components. The attachment apparatus 808 may include more (or fewer) elements than those shown in FIG. 8. It is not necessary, however, that all of these generally conventional elements be shown in order to provide an enabling disclosure. In some embodiments, the attachment apparatus 808 may be configured as described above with reference to any one of attachment apparatuses 500, 600, or 700.

As illustrated, the attachment apparatus 808 may include an input/output device interface 822, a network interface 818, an optional microphone 816, a memory 824, a processing unit 826, a power source 828, and a speaker 832, all of which may communicate with one another by way of a communication bus. The network interface 818 may provide connectivity to one or more networks or computing systems, and the processing unit 826 may receive and/or send information and instructions from/to other computing systems or services via the network interface 818. In some embodiments, the network interface 818 may be configured to communicate with the mobile computing device 802 and/or the other computing device 806 via wireless communication links 810 and 814, such as via a Wi-Fi Direct or Bluetooth communication links. The network interface 818 may also (or alternatively) be configured to communicate with the computing devices 802 and 806 via a wired communication link (not shown). Those skilled in the art will recognize that the computing devices 802 and 806 may be any of a number of computing devices capable of communicating via a wireless or wired link including, but not limited to, a laptop, personal computer, personal digital assistant (PDA), hybrid PDA/mobile phone, mobile phone, smartphone, wearable computing device (e.g., wireless headphones or earphones), electronic book reader, digital media player, tablet computer, gaming console or controller, kiosk, augmented or virtual reality device, other wireless device, set-top or other television box, or the like. In such embodiments, the network interface 818 may receive audio data from the mobile computing devices 802 and/or 806 and may provide the audio data to the processing unit 826. In such embodiments, the processing unit 826 may cause the audio data to be transformed into an electrical audio signal that is provided to the speaker 832 for output as sound.

The processing unit 826 may communicate to and from memory 824. In some embodiments, the memory 824 may include RAM, ROM, and/or other persistent, auxiliary or non-transitory computer-readable media. The memory 824 may store an operating system that provides computer program instructions for use by the processing unit 826 in the general administration and operation of the attachment apparatus 808. In some embodiments, the memory 824 may contain digital representations of audio data or electronic audio signals (e.g., digital copies of songs or videos with audio). In such embodiments, the processing unit 826 may obtain the audio data or electronic audio signals from the memory 824 and may provide electronic audio signals to the speaker 832 for playout as sound.

In some embodiments, the input/output interface 822 may also receive input from an input device (not shown), such as a keyboard, mouse, digital pen, microphone, touch screen, gesture recognition system, voice recognition system, image recognition through an imaging device (which may capture eye, hand, head, body tracking data and/or placement), gamepad, accelerometer, gyroscope, or other input device known in the art. In some embodiments, the microphone 816 may be configured to receive sound 812 from an analog sound source 804. For example, the microphone 816 may be configured to receive human speech. The microphone 816 may further be configured to convert the sound into audio data or electrical audio signals that are directly or indirectly provided to the speaker 832 for output as sound.

Each of the communication links 810 and 814 may be communication paths through networks (not shown), which may include wired networks, wireless networks or combination thereof. In addition, such networks may be personal area networks, local area networks, wide area networks, cable networks, satellite networks, cellular telephone networks, etc. or combination thereof. In addition, the networks may be a personal area network, local area network, wide area network, over-the-air broadcast network (e.g., for radio or television), cable network, satellite network, cellular telephone network, or combination thereof. In some embodiments, the networks may be private or semi-private networks, such as a corporate or university intranets. The networks may also include one or more wireless networks, such as a Global System for Mobile Communications (GSM) network, a Code Division Multiple Access (CDMA) network, a Long Term Evolution (LTE) network, or some other type of wireless network. Protocols and components for communicating via the Internet or any of the other aforementioned types of communication networks are well known to those skilled in the art and, thus, are not described in more detail herein.

In some embodiments, the attachment apparatus 808 may include one or more sensors 850. The one or more sensors 850 may include, but are not limited to, one or more biometric sensors, heat sensors, gyroscopic sensors, accelerometers, pressure sensors, force sensors, light sensors, or the like. In such embodiment, the one or more sensors 850 may be configured to obtain sensor information from a user of the attachment apparatus 808 and/or from an environment in which the attachment apparatus 808 is worn by the user. The processing unit 826 may receive sensor readings from the one or more sensors 850 and may generate one or more outputs based on these sensor readings. For example, the processing unit 826 may configure a light-emitting diode included on the attachment apparatus (not shown) to flash according to a preconfigured patterned based on the sensor readings.

It is to be understood that not necessarily all objects or advantages may be achieved in accordance with any particular embodiment described herein. Thus, for example, those skilled in the art will recognize that certain embodiments may be configured to operate in a manner that achieves or optimizes one advantage or group of advantages as taught herein without necessarily achieving other objects or advantages as may be taught or suggested herein.

Conditional language such as, among others, "can," "could," "might" or "may," unless specifically stated otherwise, are otherwise understood within the context as used in general to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

It should be emphasized that many variations and modifications may be made to the above-described embodiments, the elements of which are to be understood as being among other acceptable examples. All such modifications and variations are intended to be included herein within the scope of this disclosure and protected by the following claims.

What is claimed is:

1. An attachment apparatus for coupling to an ear of a user, the attachment apparatus comprising:

an attachment body comprising a first attachment portion and a second attachment portion and defining an opening that is configured to enable at least a portion of the ear of the user to pass through the opening when coupling the attachment apparatus to the ear, wherein:

the first attachment portion is configured to prevent an anterior portion of the ear from passing through the opening and to receive, from an interaction with the anterior portion of the ear, a force that biases the first attachment portion in a direction away from a median plane of the user, the force received on the first attachment portion causes the second attachment portion to bias in a direction towards the median plane of the user, and the attachment body is further configured to secure the attachment apparatus to the ear of the user while the first attachment portion is biased away from the median plane of the user.

2. The attachment apparatus of claim 1, wherein the first attachment portion is further configured to protrude at least partially into the opening such that the first attachment portion limits rotation of the attachment apparatus while the attachment apparatus is secured to the ear.

3. The attachment apparatus of claim 1, wherein the first attachment portion is defined at least partially in reference to a line passing between a point on a first recess of the attachment body and a point on a second recess of the attachment body.

4. The attachment apparatus of claim 1, wherein the attachment body is further configured to define, at least partially, a cavity that accommodates the first attachment portion while the first attachment portion is biased away from the median plane of the user.

5. An attachment apparatus for coupling to an ear of a user, the attachment apparatus comprising:

an attachment body, the attachment body defining an opening that is configured to enable a portion of the ear of the user to pass through the opening when coupling the attachment apparatus to the ear; and a frame coupled to the attachment body, wherein:

the attachment body and the frame are each configured to transition from a resting configuration to a deformed configuration in response to a tensile force applied to the attachment body, and when the tensile force is removed from the attachment body, the frame is configured to bias the attachment body toward the resting configuration from the deformed configuration.

6. The attachment apparatus of claim 5, wherein the frame is coupled to the attachment body to extend along at least a portion of a perimeter portion of the attachment body surrounding the opening.

7. The attachment apparatus of claim 5, wherein:

the attachment body comprises a first attachment portion and a second attachment portion;

the frame is configured to secure the attachment apparatus to the ear such that the first attachment portion receives, from an interaction with an anterior portion of the ear, a force that biases the first attachment portion in a direction away from a median plane of the user, and the force received on the first attachment portion causes the second attachment portion to press against the user.

8. The attachment apparatus of claim 5, wherein:

the frame is configured to secure the attachment apparatus to the ear such that a portion of the frame receives, from an interaction with an anterior portion of the ear, a force that biases the portion of the frame in a direction away from a median plane of the user.

9. The attachment apparatus of claim 8, wherein the force received on the portion of the frame causes a portion of the attachment body to press against the user.

10. The attachment apparatus of claim 5, wherein:

the frame comprises a first frame portion and a second frame portion;

the first frame portion is configured to secure the attachment apparatus to an upper root portion of the ear; and the second frame portion is configured to secure the attachment apparatus to a lower root portion of the ear.

11. The attachment apparatus of claim 10, wherein the frame is further configured to apply a compressive force to the ear between a point on the first frame portion and a point on the second frame portion while the attachment body is in the resting configuration.

12. An attachment apparatus for coupling to an ear of a user, the attachment apparatus comprising:

an attachment body, the attachment body defining an opening that is configured to enable at least a portion of the ear of the user to pass through the opening when coupling the attachment apparatus to the ear; and a frame coupled to the attachment body and comprising a first frame portion, wherein:

the first frame portion of the frame is configured to have a thickness greater than a space between a back surface of the posterior portion of the ear and the head of the user behind the ear with the ear in a non-displaced condition, the first frame portion of the frame is configured to displace the posterior portion of the ear in a direction away from a median plane of the user while the attachment apparatus is secured to the ear, and displacement of the posterior portion of the ear by the first frame portion biases an anterior portion of the attachment body into engagement with the user.

13. The attachment apparatus of claim 12, wherein the frame is coupled to the attachment body to extend along at least a portion of a perimeter of the opening.

14. The attachment apparatus of claim 12, wherein:

the frame body further comprises a second frame portion;

the frame is configured to secure the attachment apparatus to the ear such that the second frame portion of the attachment body receives a force from an interaction with the ear that urges the second frame portion away from a median plane of the user, and the force received on the second frame portion biases a portion of the attachment body into engagement with the user.

15. The attachment apparatus of claim 12, wherein the anterior portion of the attachment body engages with the user while the attachment body is secured to an upper portion of the ear and to a lower portion of the ear.

16. The attachment apparatus of claim 12, wherein:

the first frame portion of the frame comprises a midsection that physically contacts a back surface of the posterior portion of the ear; and the midsection curves away from the head of the user behind the ear and towards the back surface of the ear such that the midsection displaces the posterior portion of the ear in the direction away from the median plane of the user.

17. The attachment apparatus of claim 12, wherein:

at least a portion of the attachment body is configured to transition from a resting configuration to a deformed configuration in response to receiving a tensile force on the attachment body, and the frame is configured to bias the attachment body toward the resting configuration while the attachment body is in the deformed configuration.

* * * * *